US005491505A

United States Patent [19]

Suzuki et al.

[11] Patent Number: 5,491,505

[45] Date of Patent: Feb. 13, 1996

[54] INK JET RECORDING HEAD AND APPARATUS HAVING A PROTECTIVE MEMBER FORMED ABOVE ENERGY GENERATORS FOR GENERATING ENERGY USED TO DISCHARGE INK

[75] Inventors: Toshio Suzuki, Inagi; Asao Saito; Makoto Shibata, both of Yokohama; Junichi Kobayashi, Ayase; Hirokazu Komuro; Toshihiro Mori, both of Yokohama; Shuji Koyama; Sakai Yokoyama, both of Kawasaki; Ryoichi Koizumi, Yokohama; Keiichi Murakami, Hachioji, all of Japan

[73] Assignee: Canon Kabushiki Kaisha, Tokyo, Japan

[21] Appl. No.: 284,266

[22] Filed: Aug. 2, 1994

Related U.S. Application Data

[63] Continuation of Ser. No. 804,594, Dec. 10, 1991, abandoned.

[30] Foreign Application Priority Data

| | | | |
|---|---|---|---|
| Dec. 12, 1990 | [JP] | Japan | 2-409895 |
| Jan. 18, 1991 | [JP] | Japan | 3-004736 |
| Mar. 4, 1991 | [JP] | Japan | 3-061045 |

[51] Int. Cl.[6] ..... B41J 2/34; B41J 2/335; B41J 2/35

[52] U.S. Cl. ..... 347/203; 347/20; 347/56; 347/171

[58] Field of Search ..... 347/20, 23, 26, 347/55, 56, 112, 171, 177, 203, 200, 129

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,532,530 | 7/1985 | Hawkins | 346/140 R |
| 4,558,333 | 12/1985 | Sugitani et al. | 346/140 R |
| 4,567,493 | 1/1986 | Ikeda et al. | 346/140 R |
| 4,596,994 | 6/1986 | Matsuda et al. | 346/140 R |
| 4,694,306 | 9/1987 | Ikeda et al. | 346/140 R |
| 4,723,129 | 2/1988 | Endo et al. | 346/1.1 |
| 4,725,859 | 2/1988 | Shibata et al. | 346/140 R |
| 4,740,796 | 4/1988 | Endo et al. | 346/1.1 |
| 4,860,033 | 8/1989 | Shiozaki et al. | 346/140 R |
| 4,881,318 | 11/1989 | Komuro et al. | 29/827 |
| 4,940,999 | 7/1990 | Ikeda et al. | 346/140 R |
| 4,951,063 | 8/1990 | Hawkins et al. | 346/1.1 |
| 4,956,653 | 9/1990 | Braun | 346/140 R |
| 5,040,000 | 8/1991 | Yokoi | 346/140 R |
| 5,062,937 | 11/1991 | Komuro | 204/192.15 |
| 5,081,474 | 1/1992 | Shibata et al. | 346/140 R |
| 5,140,345 | 8/1992 | Komuro | 346/140 R |
| 5,157,418 | 10/1992 | Tamura | 346/140 R |
| 5,163,177 | 11/1992 | Komura | 346/1.1 |

FOREIGN PATENT DOCUMENTS

| | | |
|---|---|---|
| 0390198 | 10/1990 | European Pat. Off. . |
| 54-56847 | 5/1979 | Japan . |
| 59-123670 | 7/1984 | Japan . |
| 59-138461 | 8/1984 | Japan . |
| 59-194866 | 11/1984 | Japan . |
| 60-71260 | 4/1985 | Japan . |

OTHER PUBLICATIONS

Jou, J. H., et al., "An Analysis of Thermal Stresses in a Multilayer Thin Film Printhead", *Thin Solid Films*, Jun. 30, 1991, pp. 253–265.

*Primary Examiner*—Sandra L. Brase

*Attorney, Agent, or Firm*—Fitzpatrick, Cella, Harper & Scinto

[57] ABSTRACT

An ink jet recording head includes energy generators for generating the energy used to discharge ink and a substrate on which a circuit electrically connected to the energy generators is formed. Also provided is a protective member on an insulating layer on the substrate above the energy generators. The area of a protective member which is in contact with the ink is made to be as small as possible.

13 Claims, 21 Drawing Sheets

INK JET RECORDING HEAD AND APPARATUS HAVING A PROTECTIVE MEMBER FORMED ABOVE ENERGY GENERATORS FOR GENERATING ENERGY USED TO DISCHARGE INK

This application is a continuation of application Ser. No. 07/804,594 filed Dec. 10, 1991, now abandoned.

BACKGROUND OF THE INVENTION

1. Field of the Invention

The present invention relates to an ink jet recording head and an ink jet recording apparatus having said head.

2. Related Background Art

There are various recording methods for use with printer or facsimile apparatuses, such as a thermal method, a wire dot method or an ink jet method.

Among them, an ink jet recording method (thereinafter also referred to as "liquid jet recording method") is an effective recording method because of its relatively high recording speed, relatively low noise in recording, and excellent coloring capability. With this method, various constitutions for the discharging device thereof have been proposed in recent years, and improved for the practical use.

This ink jet recording method is one in which the recording liquid, called the ink, is discharged as fine droplets based on one of various discharge methods to stick to a recording medium such as paper for the recording. There are various methods of discharging the ink, but among them, a method of discharging the ink by the use of the heat energy has been noted recently. That is, with the ink jet recording method, the liquid, to which the heat energy is applied, is caused to undergo a state change, causing the occurrence of bubbles, and is discharged through discharge ports of the recording head due to an action force based on the state change. The recording operation is performed by discharging droplets which then stick to the recording medium.

The ink jet recording method has a feature of providing a quality image with high resolution at a fast speed, because it is not only applied quite effectively to the so-called drop-on-demand recording method, but also allows a recording head with high density multi discharge ports to be easily implemented.

A typical exemplary recording head for the apparatus to which the ink jet recording method is applied comprises discharge ports provided for discharging the liquid, ink channels each communicating with a respective discharge port and having a heat acting portion where the heat energy for use in discharging the liquid can act on the liquid, and heat energy generators as means for generating the heat energy each of which is provided to correspond to the heat acting portion.

A typical example of the heat energy generator is an electricity-heat converter comprising a pair of electrodes, and a heat generating resistive layer connected to those electrodes and having the area (heat generating portion) where the heat is generated between those electrodes.

FIG. 1 is a typical top view showing a substrate 20 on which a heat energy generator is formed according to background art. In FIG. 1, on the substrate 20 is formed, in addition to a heat energy generator 21, temperature sensors 22 for detecting the temperature of the recording head, subheaters for heating the recording head based on the head temperature detected by the temperature sensors 22 to control the temperature, and wire bonding pads 26. Further, as the substrate 20 is in contact with the ink, for example, a tantalum (thereinafter denoted as "Ta") layer 24 is provided for the uppermost layer as the ink-resistant protective layer and the anticavitation protective layer. The Ta layer 24 covers an area other than the area where the wire bonding pads 26 for holding the electrical connections to the external are disposed, that is, all of the substrate on the discharge port side (on the heat generator side of electricity-heat converter) on the opposite side of the boundary 24B in FIG. 1. Note that the ink exists within the ink channel and the common liquid chamber as the recording head is constructed by the connection of the substrate 20 and the ceiling plate, so that the contact portion of the ink with the substrate 20 is an area on the discharge port side of the boundary 25B in FIG. 1. Also, in FIG. 1, the temperature sensors 22 are disposed outside of the boundary 25B of the liquid chamber.

A typical cross-sectional view of the substrate 20 taken along the line A-B in FIG. 1 is shown in FIG. 2. As shown in FIG. 2, the Ta layer 24 covers all the substrate except for the area where the wire bonding pads 26 are disposed, or almost all the surface of the substrate. Further beneath it, $SiO_2$ layers for the insulation, Al electrodes 27, and heat generating resistive layers 27*a* composed of $HfB_2$ are formed, and within N-type Si, the functional elements of a P layer and an N layer are fabricated. However, in the related background art as above described, there were some cases in which the layer on the substrate 20 might be electrically broken. With this breakdown, it could be found that a specific breakdown mode frequently occurred. That mode is shown in FIG. 3.

This breakdown mode is one in which an insulating layer between Al wiring electrodes 27 and the Ta layer 24 which is the uppermost layer undergoes a breakdown to cause a short-circuit, so that the Ta layer 24 itself becomes molten with the heat of the short-circuit. The breakdown area is shown in the area within circle D. This can be thought of in the following way. That is, electrical charges due to the static electricity stored in some portion of the recording head are passed via the wire bonding pads 26 into the Al wiring 27 to be accumulated therein, so that the potential of the Al wirings become quite high. On the other hand, as the Ta layer is an electrical conductor which tends to be a ground voltage when placed into contact with the ink, the Ta layer 24 is rarely charged with quantity of respect to the electrical charges therein. As a result, a quite strong electric field will be produced on the insulating layer $SiO_2$ between the Ta layer 24 and the Al wiring 27. If this electric field is stronger than a certain value, a discharge may arise between the Ta layer 24 and the Al wiring 27, thereby causing the breakdown. The Ta layer 24 becomes molten with the heat generated at this time, so that the Al wiring 27 is exposed. The breakdown as shown in FIG. 3 can be though to occur as above described.

The intensity of electric field formed between the Ta layer and the Al wiring depends on the electrostatic capacity between the Ta layer and the Al wiring. Accordingly, it is conceived that if the area of the Ta layer is reduced as above, the intensity of electric field formed may be smaller, so that the breakdown due to such a discharge is less likely to occur. Furthermore, a reduced area of the Ta layer as above described reduces the probability of the breakdown occurring on the substrate.

In addition, the breakdown mode has a positional dependence, which allows potential sites for the breakdown to be classified into more and less likely sites likely site of the breakdown. The more is the portion of around the temperature sensors 22 and subheaters 23, and the step portion of the A1 wirings connected to them, as shown in FIG. 1. Moreover, it seems that the breakdown is less likely to occur in a central portion of the substrate 20.

Although the details will be described later, the present invention has been developed based on such a view of the inventor.

FIG. 20 is a typical cross-sectional perspective view showing a liquid jet recording head. On a substrate 1102 are formed electricity-heat converters consisting of heat generating resistive layers having heat generators 1103, electrodes 1104 connected thereto, and liquid channel walls, via the semiconductor fabrication processes such as etching, vapor deposition or sputtering, on which a ceiling plate 1106 is further provided. The recording liquid (ink) 1112 is supplied from a liquid reserving chamber, not shown, through a liquid supply tube 1107 into a common liquid chamber 1108 of recording head 1101. In the figure, 1109 is a connector connected to the liquid supply tube. The liquid 1112 supplied into the common liquid chamber 1108 moves into liquid channels 1110 with the so-called capillary phenomenon, and is held stably by forming the meniscus at the discharge port communicating to the liquid channel. Here, by energizing the heat generators of the electricity-heat converters 1103, the liquid on the heat generators is rapidly heated, producing bubbles in the liquid channels, so that the liquid is discharged through discharge ports 1111 due to expansion and shrinkage of bubbles while forming liquid droplets. And a multi discharge port ink jet recording head is formed at a high discharge port array density of 16 nozzles/mm, i.e., with 128 or 256 discharge ports, or with a plurality of discharge ports arranged over an entire recording width of recording medium.

The electricity-heat converter is conventionally formed with various protective films, thereby causing the life of electricity-heat converter to be lengthened and the liquid to be stably discharged. The constitution of the protective layer is as described in Japanese Patent Laid-Open Application No. 59-194866, for example. In each figure of FIGS. 16 to 19, the head structure as disclosed in the same patent is shown. In each figure, on carriers 405, 505 are formed under layers 406, 506, and further heat generating resistive layers 407, 507, on which common electrodes 404, 504 and selective electrodes 403, 503 are provided. 402, 502 are heat generators of electricity-heat converters (thereinafter referred to as "heater"). On the heat generators formed in this way are laminated inorganic first protective layers 408, 508 made of $SiO_2$, for example, on the upper face of which are laminated further inorganic second protective layers 409, 509 made of Ta, for example, and organic third protective layers 411, 511, if necessary, in which each protective layer is generally formed not only on the upper portion of electrode, but also on the entire face including the upper portion of under layer. Note that the liquid chamber is generally constituted of a first inorganic protective layer and a third organic protective layer (for example, "Photoneath" made by Toray Industries, Inc., "PIQ" made by Hitachi, Ltd.) laminated sequentially, and further a second inorganic protective layer may be laminated thereon, if necessary.

However, there are following drawbacks associated with this conventional example.

(1) During the fabrication process, when Ta or $SiO_2$ is etched, pin holes may arise so that the electrical leakage between the wiring and the ink tends to occur, thereby decreasing the yield for the fabrication.

(2) Since the second inorganic protective layer is provided over the heating portion or the liquid chamber section in some cases, the adhering force of the film might be sometimes decreased because of increased film stress. As a result, the life of a liquid jet recording head is sometimes shortened because of larger thermal damage that occurs in the discharging operation.

By the way, with this ink jet recording head, the ink forms bubbles and is discharged by energizing the heater, which may be damaged by the cavitation when the bubbles produced in the ink disappear. Therefore, an anticavitation layer is provided over the surface of the heater on the liquid channel side, so as to prevent the heater from damage due to such cavitation. The second layer in FIG. 20 corresponds to this anticavitation layer.

Conventionally, the anticavitation layer was formed, with the sputtering method, under film formation conditions where the internal stress was almost zero, as the strength of the anticavitation layer would decrease if the stress remained within the inside of the anticavitation layer. However, with the conventional ink jet recording head as above mentioned, there is the problem that the durability of the anticavitation layer might vary greatly among heads having the anticavitation layer formed even under the same film formation conditions. For example, when the heater was repeatedly energized $10^8$ times, the survival rate of the anticavitation layer was between 50 to 100%, so that the reliability of the ink jet recording head might not be assured.

SUMMARY OF THE INVENTION

In view of the foregoings, it is an object of the present invention to provide an ink jet recording a head and an ink jet recording apparatus having said head, which is unlikely to cause Ta breakdown, for example, due to the electrostatic discharge, in an inexpensive constitution without using special countermeasure parts against static electricity.

According to the present invention, there is provided an ink jet recording head having energy generators for generating the energy used to discharge the ink and a substrate on which a circuit electrically connected to the energy generators is formed, characterized in that the area of a protective member which is formed above the energy generator and the circuit via an insulating layer on the substrate, and in contact with the ink is minimized, as required.

Also, there is provided an ink jet recording apparatus for recording, comprising an ink jet recording head having energy generators for generating the energy used to discharge the ink and a substrate on which a circuit electrically connected to the energy generators is formed, characterized in that the area of a protective member which is formed above the energy generators and the circuit via an insulating layer on the substrate, and in contact with the ink is minimized as required. With the above constitution, if the area of a layer in contact with the ink on the substrate on which the energy generators are formed and having the electrical conductivity and ink resistance is minimized, as required. It is possible to make small the probability of causing discharge breakdown due to the electrostatic discharge between a driving circuit such as A1 wiring, a temperature sensor and a heater, which are formed on the above-mentioned layer and the substrate.

It is another object of the present invention to provide a liquid jet recording head and a liquid jet recording apparatus having a head which is highly reliable in the manufacturing process.

According to the present invention, there is provided a liquid jet recording head comprising a heat generating portion comprising an electricity-heat converter for generating the energy used to discharge the ink, and a common electrode and a selective electrode for supplying the electricity to the heat generating portion in a liquid channel formed on a substrate carrier, characterized in that a first upper protective layer is formed so as to cover at least an upper surface of the heat generating portion. The common electrode and the selective electrode, and a second upper protective layer is formed only on the first protective layer above the heat generator portion, the common electrode and the selective electrode. With the above costitution, when the first protective layer (e.g., $SiO_2$) is etched, the second protective layer serves as an etching stopping layer, because the first and second protective layers have large selectivity by the provision of the second protective layer even if there is an irregularity in the wiring for each electrode on the under layer, thereby reducing pin holes arising on the first protective layer, so that it is possible to reduce the electrical leakage between the wiring and the ink.

Also, by providing the second protective layer (e.g., Ta) on the wiring, the first protective layer (under layer) is not damaged when the second protective layer is etched, thereby reducing the pin holes, so that the electrical leakage between the wiring and the ink can be reduced.

Further, because the second protective layer is provided only on the wiring but not over an entire chip (the second protective layer is provided for each wiring), stress is reduced, and the adhering force of the film is improved. As a result, thermal damage can be reduced, and the life of the liquid jet recording head can be lengthened.

It is a further object of the present invention to provide an ink jet recording head with an improved reliability by increasing the durability of the anticavitation layer without depending on minute factors of the film formation conditions, and an ink jet recording apparatus using the ink jet recording head.

According to the present invention, there is provided an ink jet recording head having a path communicating to a discharge port for discharging the ink, and a heat energy generating element disposed on the path for generating the heat energy used to discharge the ink through the discharge port, in which the heat energy generated by the heat energy generating element causes the ink within the path to produce bubbles to discharge the ink through the discharge port, characterized in that an anticavitation layer is provided on a face opposed to the path of the heat energy generating element for preventing the breakdown of the heat energy generating element due to the cavitation which may arise when the bubbles disappear, and the internal stress of the anticavitation layer is a compression stress.

In particular, the internal stress of the anticavitation layer should be a compressive stress from $1\times10^8$ to $3\times10^{10}$ dyn/cm$^2$, and the anticavitation layer should be made of tantalum. The heat energy generating element should be an electricity-heat converter. A full-line type having a plurality of discharge ports provided over an entire width of the recording area of recording medium may be used.

As the internal stress of the anticavitation layer is a compressive stress, the anticavitation layer will not be broken even if the heat energy generating element is repeatedly driven, as will be clear from the experimental result as hereinafter described.

DETAILED DESCRIPTION OF THE PREFERRED EMBODIMENTS

In the following, the examples of the present invention will be described with reference to the drawings.

Figure 4:
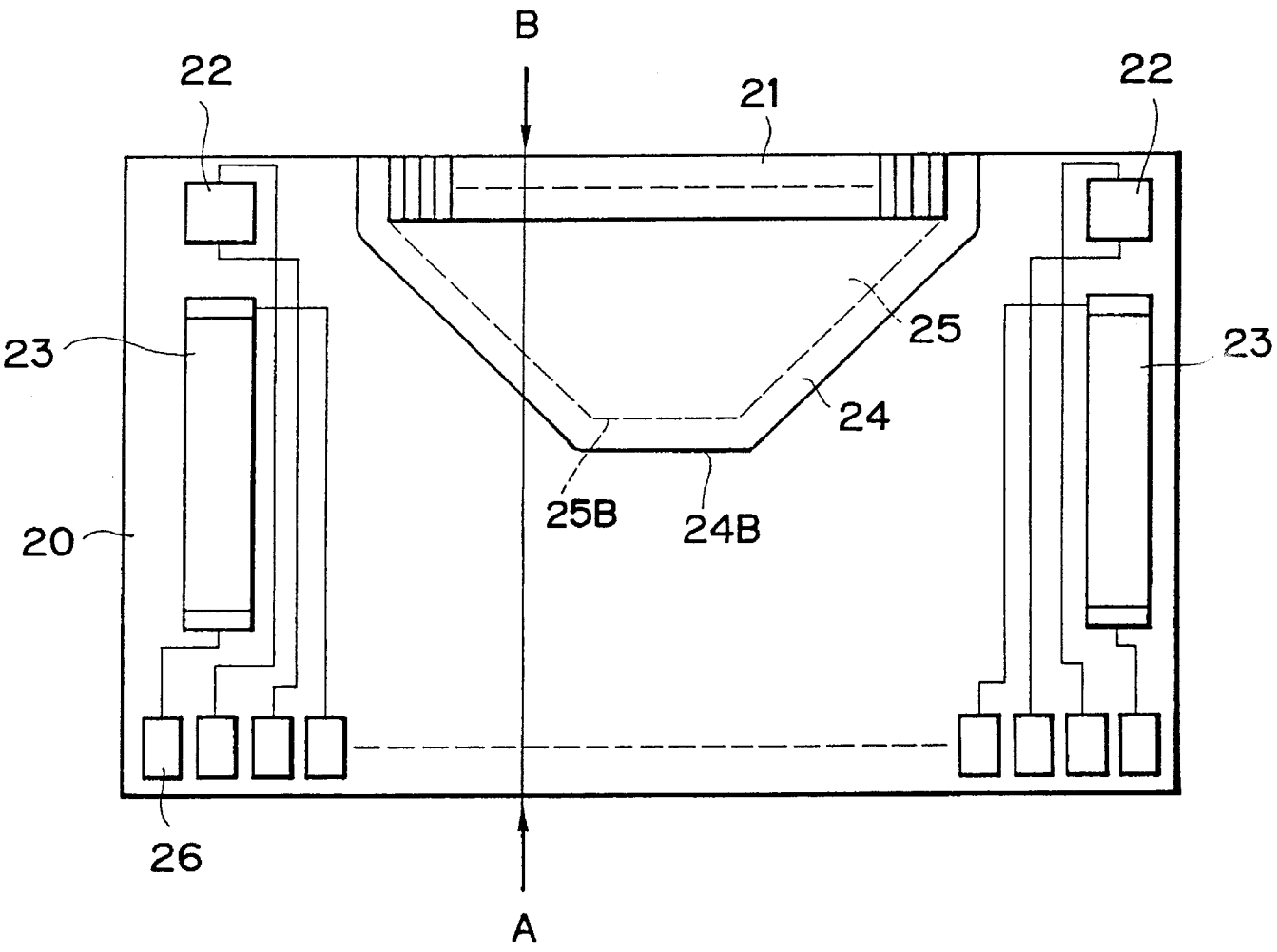
FIG. 4 is a cross-sectional view of the substrate in one embodiment of the present invention.

FIG. 4 is a typical plan view showing a substrate constituting an ink jet recording head in one embodiment of the present invention. The same numerals are attached to corresponding elements in FIGS. 1 and 4, and the detailed explanation thereof will be omitted.

On the substrate 20 are formed a plurality of electricity-heat converters 21, temperature sensors 22, subheaters 25 and wire bonding pads 26 which are disposed on both right and left sides of the substrate 20, respectively. The substrate 20 has the portion directly in contact with the ink, i.e., a portion on which a plurality of electricity-heat converters 21 are arranged, and a portion following the arranged portion, on which a common liquid chamber of the recording head is constituted. Those portions are shown in FIG. 4 as the region from a liquid chamber interface 25B to the array portion of the electricity-heat converters 21. Originally, the Ta layer having an electrical conductivity as the protective layer serves to protect the substrate from the ink, and its necessary minimum area is limited to the area of a region where the ink is directly in contact with the substrate. Accordingly, as shown in FIG. 4, the existing area of the Ta layer 24 can be indicated by a contour of boundary 24B. That is, the Ta layer 24 is formed on the array side of electricity-heat converters from the liquid chamber boundary 24B. In this way, it will be found that Ta is formed as the ink protective layer on a necessary minimum region.

Figure 5:
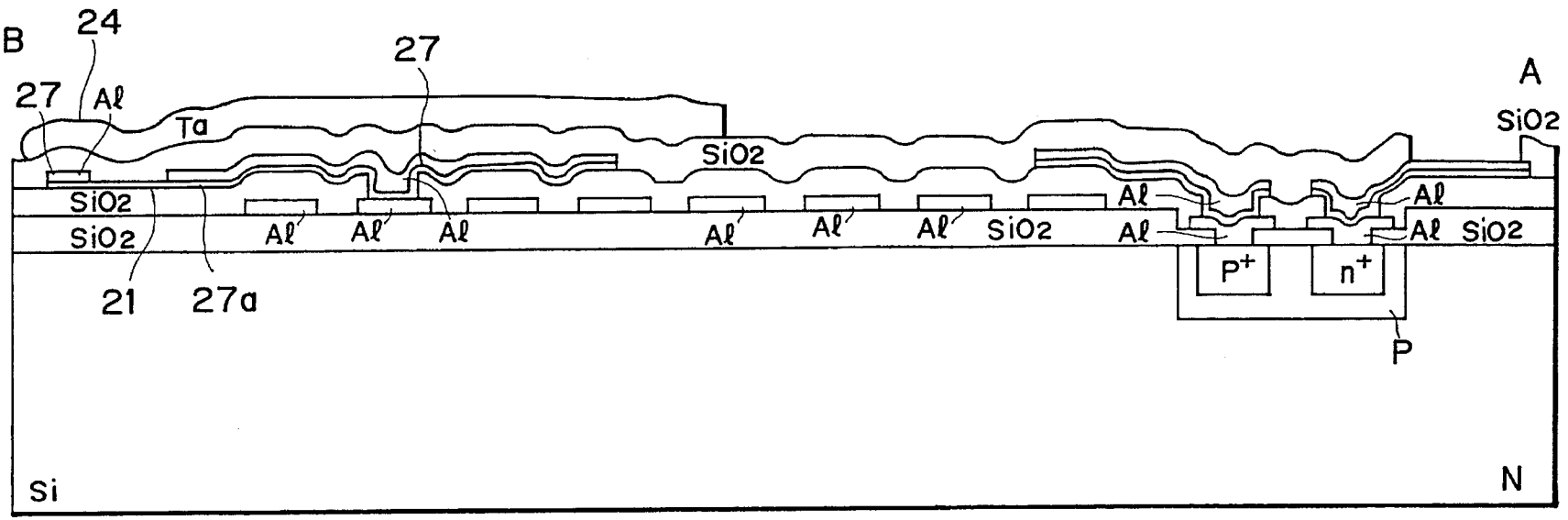
FIG. 5 is a cross-sectional view of the substrate as shown in FIG. 4.

A typical cross-sectional view taken along the line A-B in FIG. 4 is shown in FIG. 5.

As can be seen from FIG. 5, the Ta layer 24 is formed on the B side as shown where the electricity-heat converters exist, and the Ta layer 24 is formed on the A side as shown in a region almost outside of the common liquid chamber 25.

With the above constitution, it was possible to suppress the discharge breakdown due to static electricity between the Ta layer and the Al wiring at a minimum. An ink jet recording head was fabricated on this substrate, so that a high quality head with a high durability can be obtained.

Figure 6:
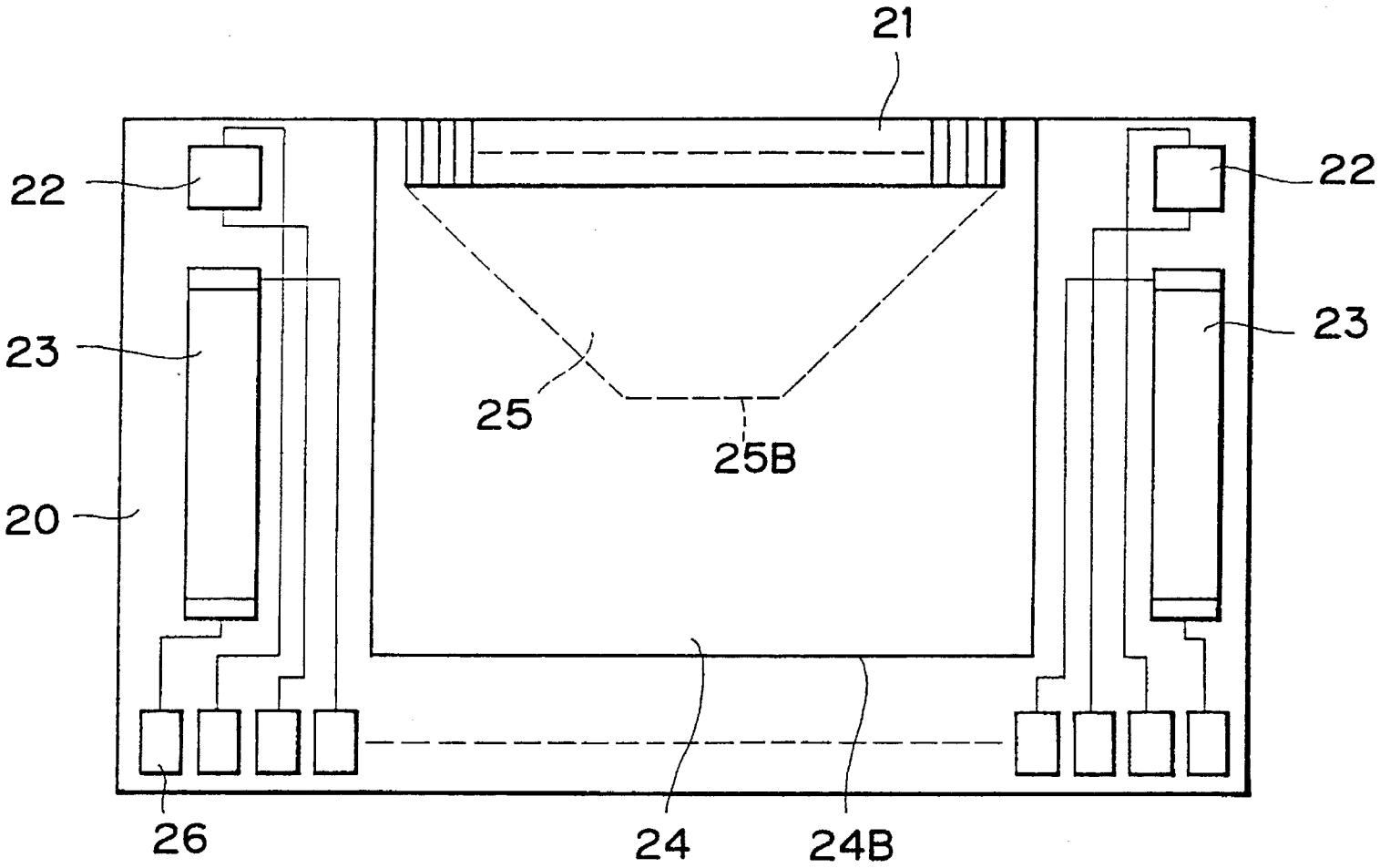
FIG. 6 is a schematic upper view of the substrate in another embodiment of the present invention.

FIG. 6 is a typical plan view showing the substrate in another example of the present invention.

Figure 1:
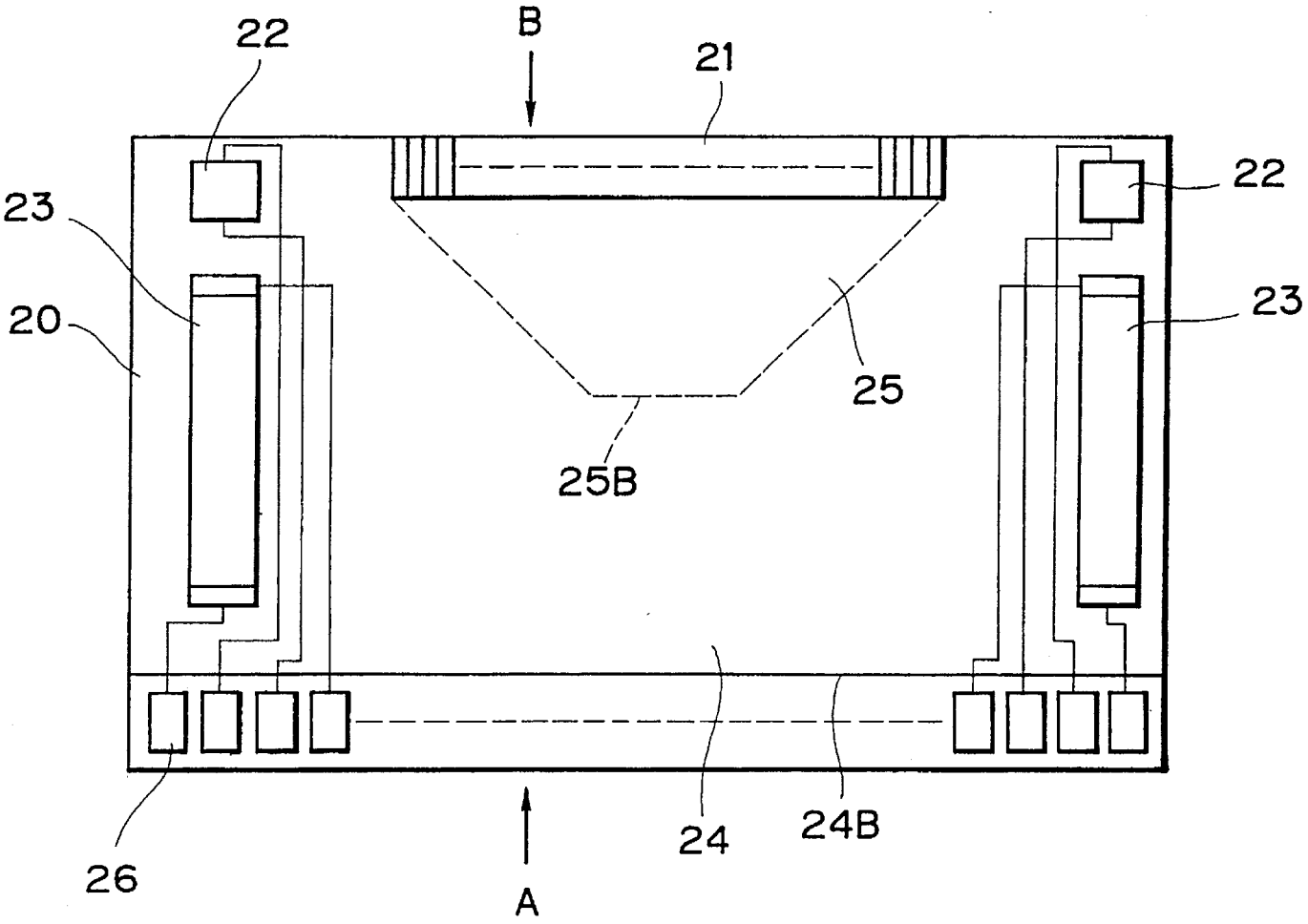
FIG. 1 is a schematic upper view showing an example of a substrate of an ink jet recording apparatus in the related background art.
Figure 2:
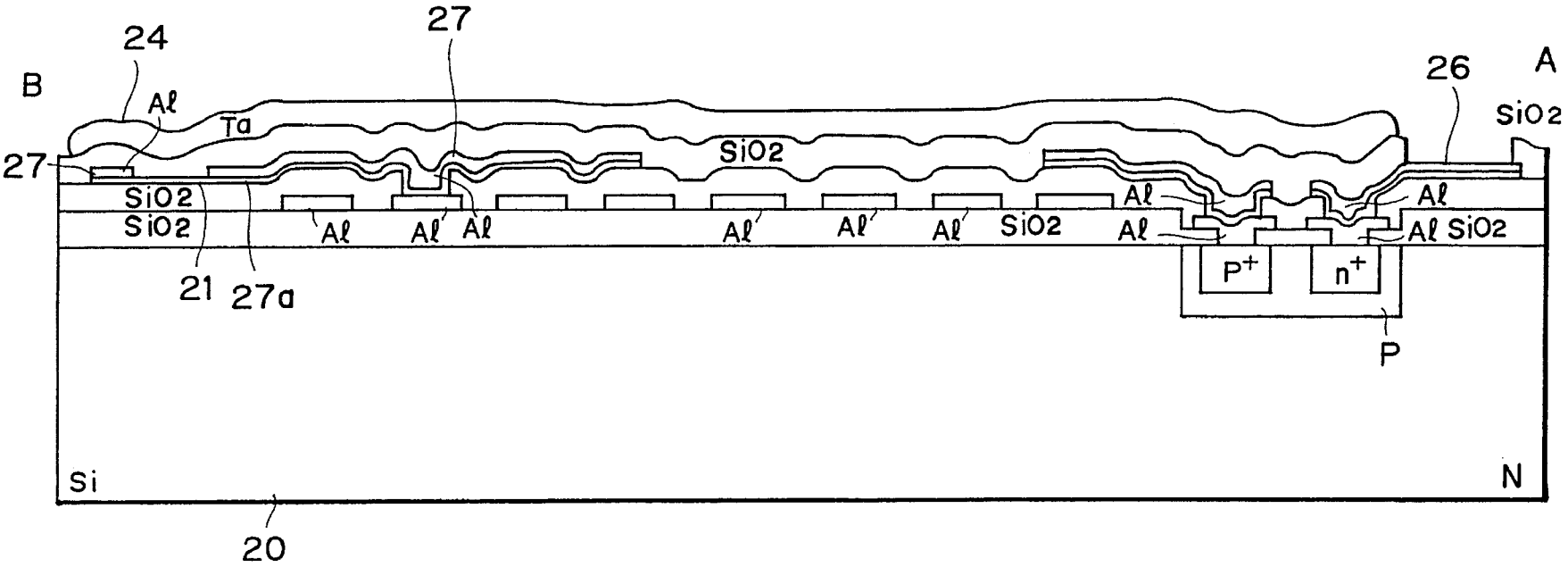
FIG. 2 is a cross-sectional view of the substrate as shown in FIG. 1.
Figure 3:
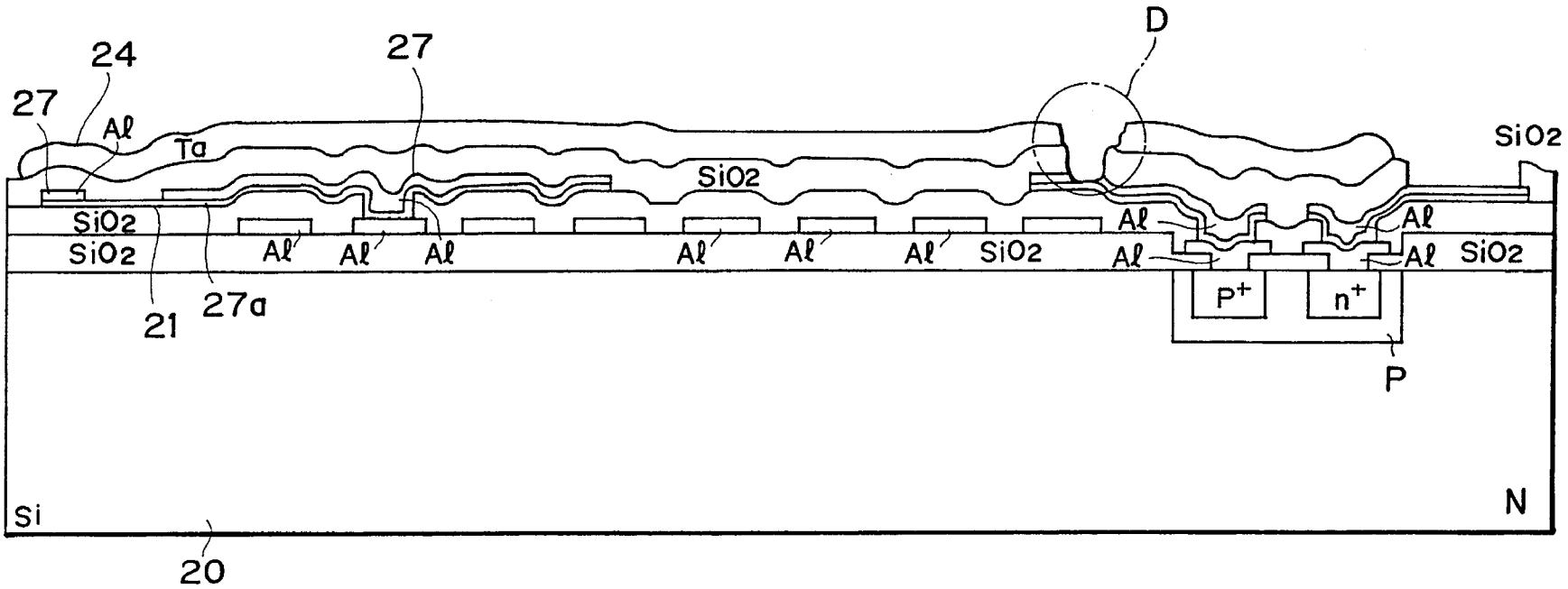
FIG. 3 is a cross-sectional view of the substrate for explaining the discharge breakdown arising on the substrate.

In this embodiment, like the previous example, there are provided electricity-heat converters 21, temperature sensors 22, subheaters 23, and wire bonding pads 26 on the substrate 20. Also in this embodiment, the boundary 24B of the Ta layer 24 is extended around the region where the temperature sensors 22 and the subheaters 23 are excluded and the whole portion corresponding to the common liquid chamber 25 is included, and up to a portion substantially immediately before where the wire bonding pads 26 are disposed. In this case, the area of the Ta layer 24 is an intermediate area between the minimum area of the Ta layer as shown in FIG. 4, and the maximum area as shown in FIG. 1. With this embodiment, an excellent head could be also obtained.

Figure 7:
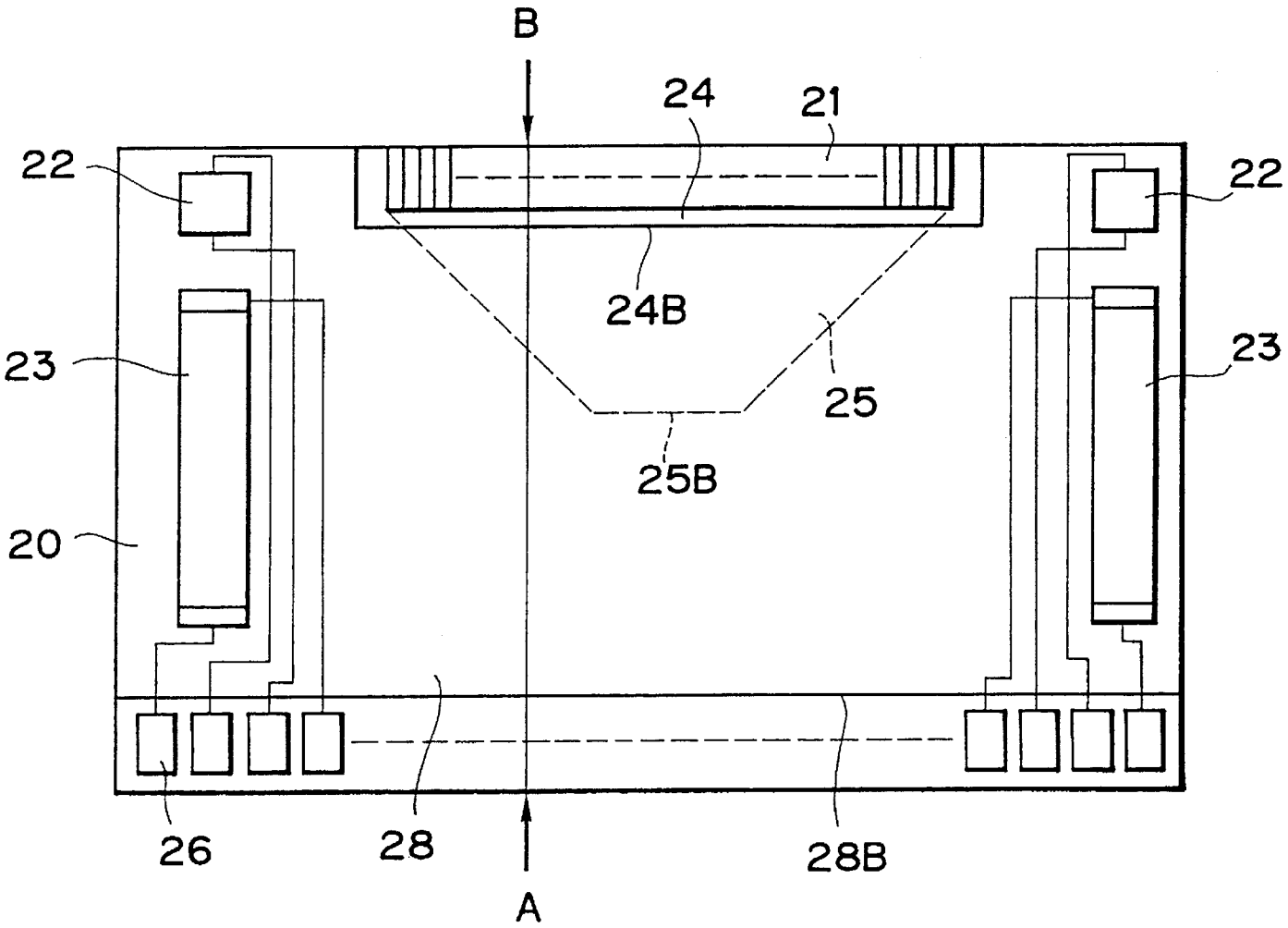
FIG. 7 is a schematic upper view of the substrate in another embodiment of the present invention.
Figure 8:
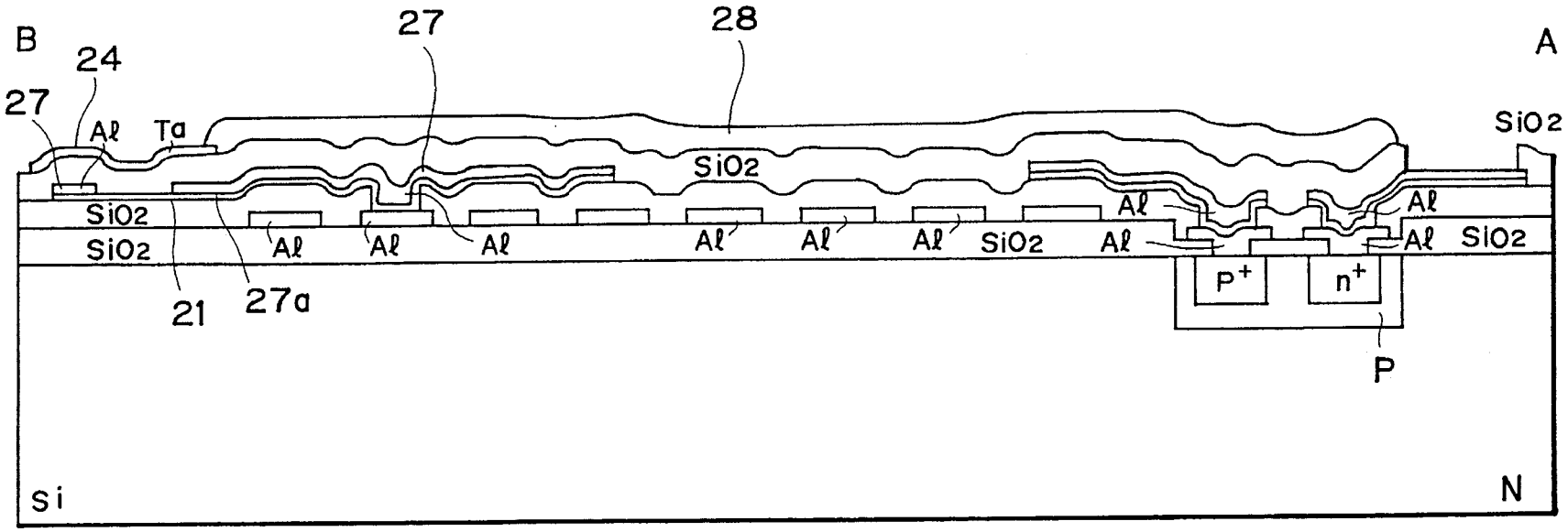
FIG. 8 is a cross-sectional view of the substrate as shown in FIG. 7.

FIGS. 7 and 8 show still another example. In these figures, the Ta layer 24 is provided only on a portion where electricity-heat converters 21 are arranged. This is because this portion is required to have a protective layer of Ta for the anticavitation, as well as an ink resistive layer. However, on other portions, it is not necessary to protect the electricity-heat converters from the cavitation caused by disappearing bubbles in discharging the ink, but only a protective layer is required to resist the ink. Accordingly, this portion can be constituted of a protective layer other than Ta. In this embodiment, the Ta layer only exists on the array portion of electricity-heat converters as previously described, and on the other portion except where wire bonding pads are disposed, an insulating layer is used. The insulating film is Photoneath made by Toray Industries, Inc. for the organic film, and SiN for the inorganic film. The kind of film can be determined by the property of the ink, for example. As the insulating film was used on most of the portions, no short-circuit was caused with the conductive layer such as the Ta layer when the electrostatic discharge occurred, so that a recording head having a high static electricity resistance could be obtained.

In the above explanation, an example of using an N-type Si substrate was described, but a P-type Si substrate may be used. Also, for the ink resistant layer and the anticavitation layer, other metallic films, for example, Nb, Hf, Ti, Zr, V and their alloys may be used.

Figure 9:
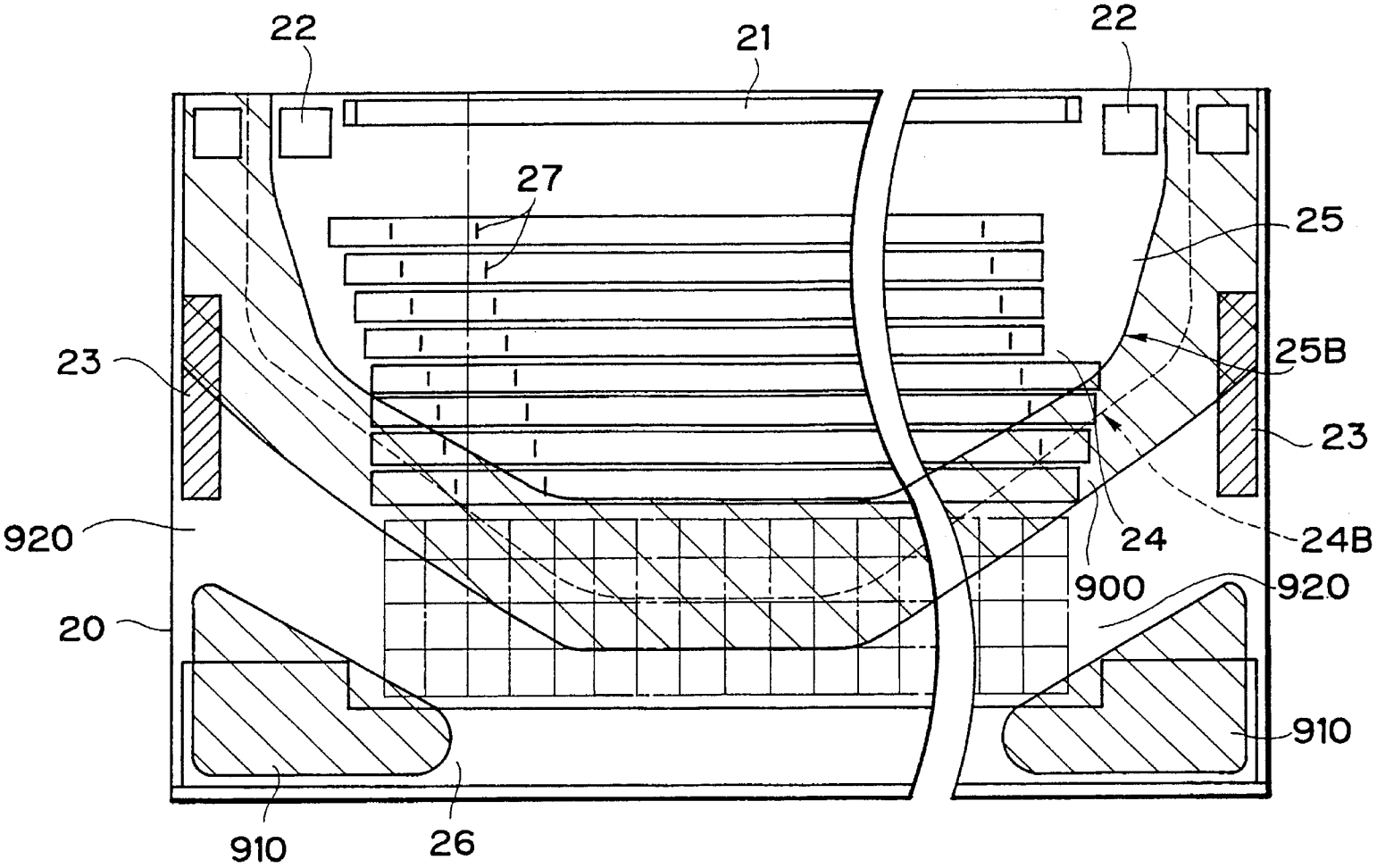
FIG. 9 is a schematic upper view of the substrate in still another embodiment of the present invention.

FIG. 9 is a typical plan view showing a substrate in still another embodiment of the present invention.

While in the above embodiments, the temperature sensors are disposed on a portion other than a portion corresponding to the common liquid chamber, and the Ta layer is not formed on the temperature sensor. In this embodiment, the temperature sensors 22 are disposed within the common liquid chamber 25, and the Ta layer 24 is formed thereon, as shown in FIG. 9. As previously described, if the Ta layer is formed in the region where the temperature sensor is disposed, discharge breakdown may be likely to occur on this portion, but if the entire area of the Ta layer 24 is made relatively smaller than that of a charging unit such as the Al wiring on the substrate so as to reduce the intensity of electric field formed by the charging, it is possible to decrease the tendency of causing discharge breakdown.

In this embodiment, since the Ta layer can transmit the heat of the ink or electricity-heat converters rapidly with its thermal conductivity, if the temperature sensor 22 is disposed near the array portion of electricity-heat converters 21 within the common liquid chamber 25, and the Ta layer 24 is formed on an upper layer of the temperature sensor 22, it is possible to achieve an efficient, accurate temperature detection of the ink within the recording head with the temperature sensor 25. From the above-mentioned various reasons, the embodiment of FIG. 9 is most preferable from all aspects.

Also, it is possible to make uniform the heat distribution within the recording head, particularly, the heat distribution on a plurality of electricity-heat converters, with the thermal conductivity of the Ta layer. For example, the shape of a portion where the Ta layer is formed can be determined in accordance with the temperature distribution of the array portion of electricity-heat converters produced by discharging the ink, while taking into consideration the discharge breakdown.

Note that the slanting portions 900 and 910 as shown in FIG. 9 are a partition wall and a convex portion formed on a ceiling plate for constituting the recording head, in which its bottom face is to be joined with the substrate at the slanting portions when the ceiling plate and the substrate 20 are joined.

In this embodiment, the Ta film is disposed up to the boundary as shown by 24B, with this boundary being located almost on a central portion of the slanting portion 900 where the ceiling plate and the substrate are joined.

With such a constitution, the area of the Ta layer can be reduced as much as least as possible, and a sufficient protection ability from the ink can be obtained.

The partition wall 900 serves to partition the common liquid chamber 25. The convex portion 910 has the following features of joining the substrate. That is, first of all, when the substrate 20 and the ceiling plate are joined, an under face of the convex portion 910 and the substrate 20 are tentatively affixed with an adhesive for the accurate alignment between the electricity-heat converter and the discharge port. Then the under face of the convex portion 910 is formed with a corrugated plane having minute repetitive undulations, so that the amount of adhesive can be adjusted with this plane. That is, if the adhesive excessive, excess adhesive is placed into corrugated concave portion, and does not bulge out into other portions to adversely affect the substrate. Secondly, a groove 920 is formed between partition walls, this groove 920 serving as a guide groove for injecting a sealant into a junction between the ceiling plate and the substrate. Note that the sealant desirably has an elasticity such as a sealant containing Si.

In the above embodiment, Ta was mentioned as the material having the ink resistant property and the anticavitation property and constituting the uppermost layer on the substrate, but the material is not limited to Ta, and other materials can be used if the electrical conductivity is provided in addition to the above characteristics.

Figure 13A:
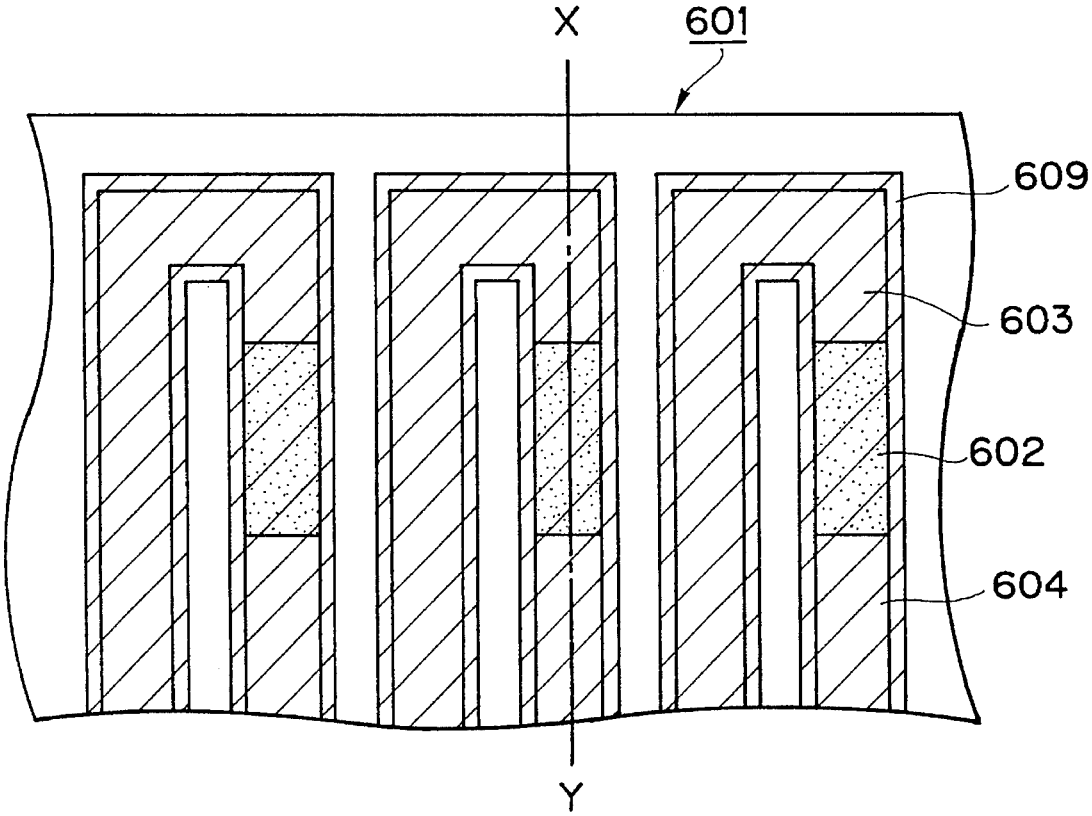
FIG. 13A is a partial enlarged plan view showing the neighborhood of heat generator in one embodiment of the liquid jet recording head according to the present invention.
Figure 13B:
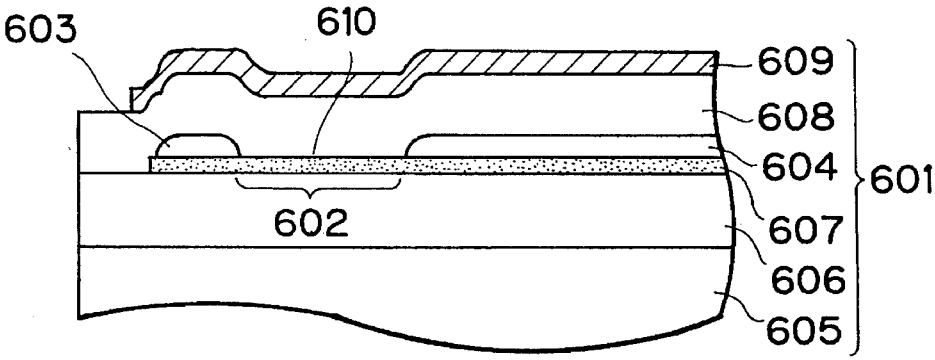
FIG. 13B is a partial cross-sectional enlarged view taken along the line X-Y in FIG. 13A.

FIG. 13A is a typical plan view of the substrate for the liquid jet recording head in the vicinity of the electricity-heat converter, and FIG. 13B is a partial cross-sectional view taken along the dot and dash line XY as shown in FIG. 13A.

In FIGS. 13A and 13B, 601 is a substrate. The substrate 601 comprises a carrier 605 made of a material such as silicon, glass and ceramics, a lower layer 606 made of $SiO_2$ on the carrier 605, heating resistive layers 607, common electrodes 604 and selective electrodes 603 laminated on the portion except for heat generators 610 of the heating resistive layers 607, a first upper protective layer 608 covering the heat generators 610, the common electrodes 604 and the selective electrodes 603, and a second upper protective layer 609 laminated in accordance with its lower structure. In this case, the second upper protective layer 609 is provided only over the heating resistive layers 607, the heat generators 610, the common electrodes 604 and the selective electrodes 603, and on the first upper protective layer 608.

A main role of the first upper protective layer 608 laminated at least on the heating region 602 and the electrodes 603, 604 is to retain an insulating property, and as its material, an inorganic insulating material is preferred, for example, an inorganic oxide such as $SiO_2$ or an inorganic nitride such as $Si_3N_4$, relatively excellent in the thermal conductivity and the heat resistivity.

As the material constituting the first upper protective layer 608, in addition to the inorganic insulating material as above mentioned, other materials can be used such as a transition metallic oxide such as titanium oxide, vanadium oxide, niobium oxide, molybdenum oxide, tantalum oxide, tungsten oxide, chromium oxide, zirconium oxide, hafnium oxide, lanthanum oxide, yttrium oxide or manganese oxide, a metallic oxide such as aluminum oxide, calcium oxide, strontium oxide, barium oxide or silicon oxide, and their complex, a high resistive nitride such as silicon nitride, aluminum nitride, boron nitride or tantalum nitride, and their complex of oxide or nitride, and the bulk of semiconductor such as amorphous silicon or amorhous selenium, which is a thin film material that can be made highly resistive in the manufacturing process such as the sputtering method, the CVD method, the vapor deposition method, the gas phase reaction method or the liquid coating method, irrespective of their low resistivity. The film thickness of the first upper protective layer 608 is generally from 0.1 to 5 μm, preferably from 0.2 to 3 μm, and most preferably from 0.5 to 3 μm. As the method of forming the protective layer, the sputtering method, the CVD method, the vapor deposition method, the gas phase reaction method, and the coating method can be suitably used.

As the material useful for forming the second upper protective layer 609, in addition to Ta as above mentioned, a group III element in the periodic table can be used such as Sc or Y, a group IV element such as ti, Zr or Hf, a group V element such as V or Nb, a group VI element such as Cr, Mo or W, a group VIII element such as Fe, Co or Ni, an alloy of the above-cited metals such as Ti—Ni, Ta—W, Ta—Mo—Ni, Ni—Cr, Fe—Co, Ti—W, Fe—Ti, Fe—Ni, Fe—Cr, Fe—Ni—Cr, a boride of the above-cited metals such as Ti—B, Ta—B, Hf—B or W—B, a carbide of the above-cited metals such as Ti—C, Zr—C, V—C, Ta—C, Mo—C or Ni—C, a silicide of the above-cited metals such as Mo—Si, W—Si, Ta—Si, and a nitride of the above-cited metals such as Ti—N, Nb—N or Ta—N, can be used.

The second upper protective layer can be formed using the above-cited materials, with the vapor deposition method, the sputtering method or the CVD method, its film thickness being generally from 0.01 to 5 μm, preferably from 0.1 to 5 μm, and most preferably from 0.2 to 3 μm.

As a result of a test with the electrical leakage between the wiring of liquid jet recording head fabricated in the above-described manner and the ink, the number of defective heads can be reduced to one-fifth or less, whereby the yield is improved (i.e., the percent of defectives heads was conventionally about 10 to 20%, but could be reduced to about 2% in this example).

Also, as a result of an endurance number test which was made using this liquid jet recording head for five days with $4\times10^8$ times per day, $10^9$ times of recording could be stably attained, and excellent recording characteristics were maintained without disconnection of the head. Particularly, a high speed recording head had its endurance number increased several times, and thus a good durability head was produced.

Figure 14:
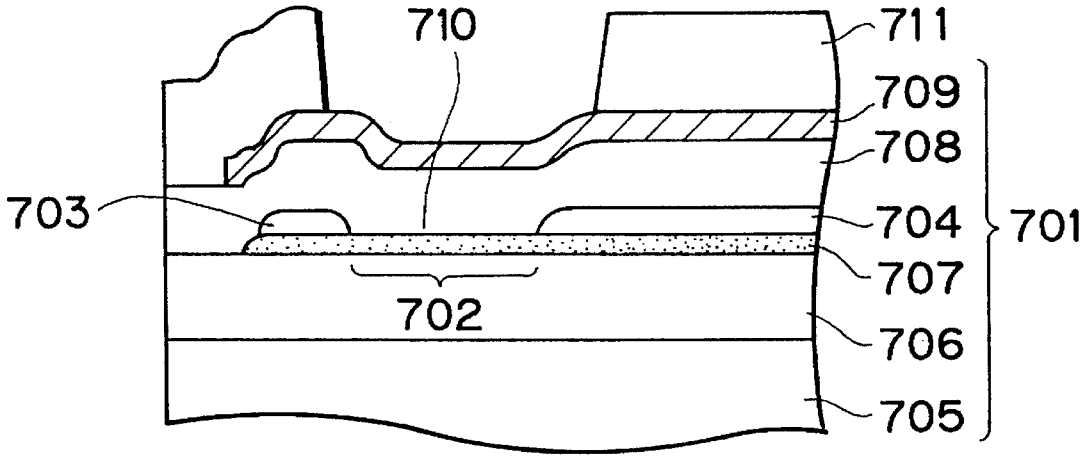
FIG. 14 is a partial cross-sectional enlarged view showing the neighborhood of the heat generator in another example of a liquid jet recording head according to the present invention.

A still further embodiment is shown in FIG. 14. Even if the organic protective layer was laminated on the second protective layer 709 as shown in FIG. 14, exactly the same effects can be obtained. Note that the material of the first protective layer is $SiO_2$, with its thickness being 1.0 μm. The material of the second protective layer is Ta, with its thickness being 0.6 μm.

The material of the organic protective layer is one which is easily processed with fine photolithography, for example, polyimidoisoindoroquinazolinedione (tradename: PIQ, made by Hitachi Chemical Co., Ltd.), polyimide resin (tradename: PYRALIN, made by Dupon), cyclopolybutadiene (tradename: JSR-CBR, made by Japan Synthetic Rubber Co., Ltd.), Photoneath (tradename: made by Toray Industries, Inc.), and other photosensitive polyimide resins.

Figure 15:
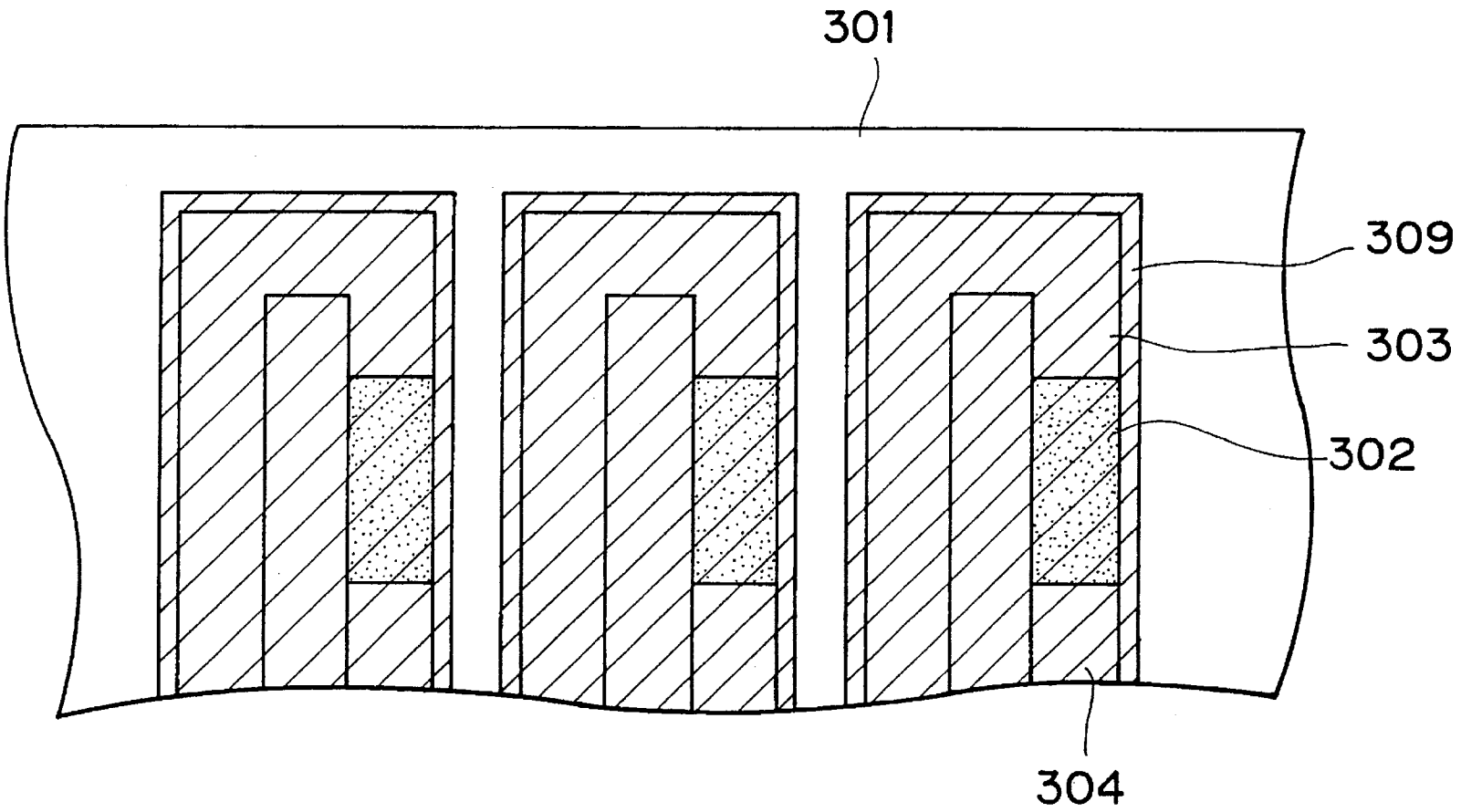
FIG. 15 is a partial cross-sectional enlarged view showing the neighborhood of the heat generator in still another example of a liquid jet recording head according to the present invention.
Figure 16A:
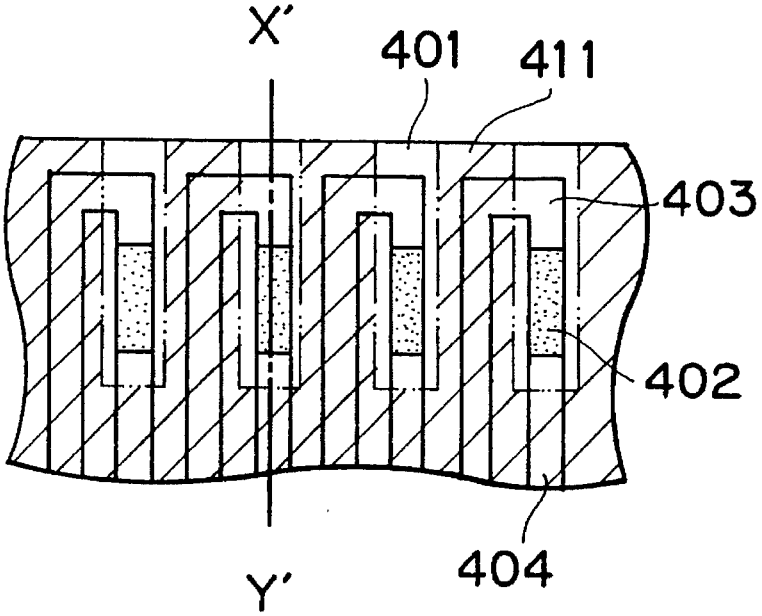
FIG. 16A is a partial enlarged plan view showing the neighborhood of the heat generator in a conventional example of a liquid jet recording head.
Figure 16B:
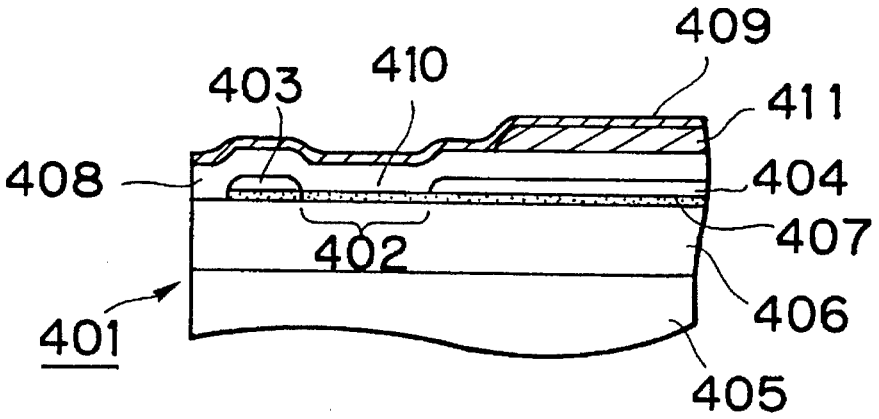
FIG. 16B is a partial cross-sectional enlarged view taken along the line X'-Y' in FIG. 16A.
Figure 17A:
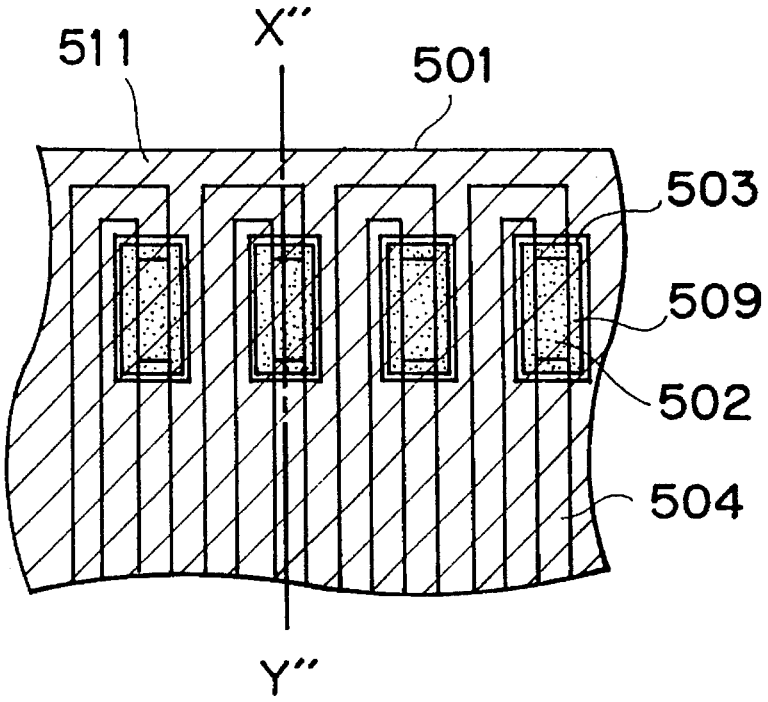
FIG. 17A is a partial enlarged plan view showing the neighborhood of heat generator in another conventional embodiment of a liquid jet recording head.
Figure 17B:
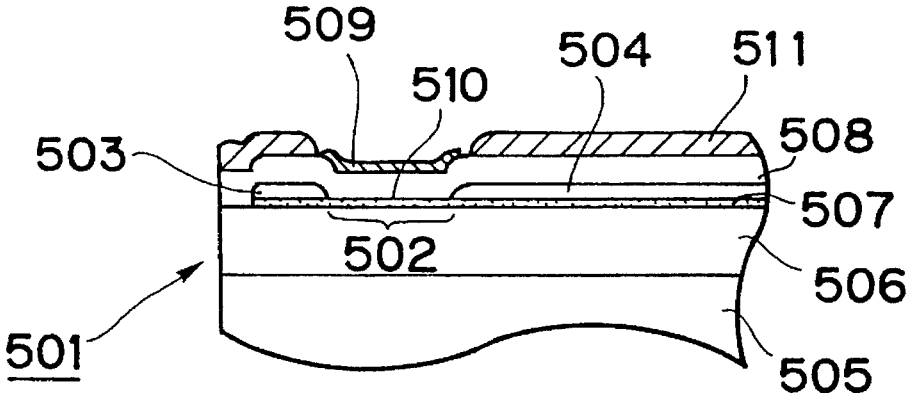
FIG. 17B is a partial cross-sectional enlarged view taken along the line X"-Y" in FIG. 17A.
Figure 18:
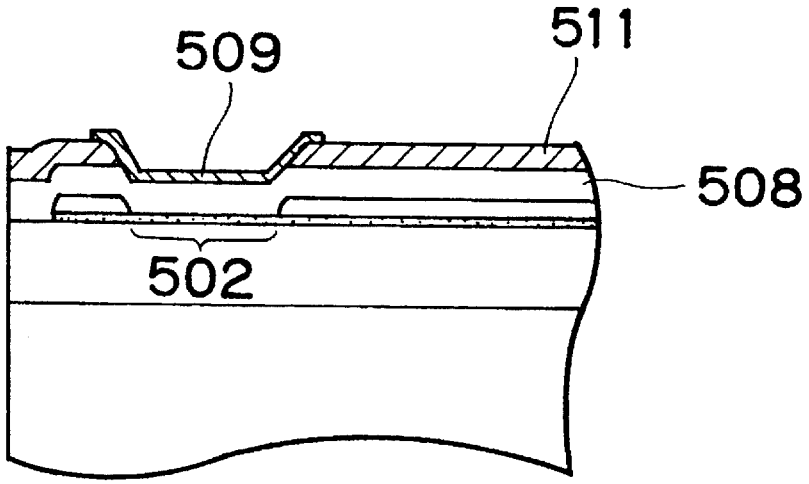
FIG. 18 is a partial cross-sectional enlarged view of a conventional recording head provided on a third upper protective layer.
Figure 19:
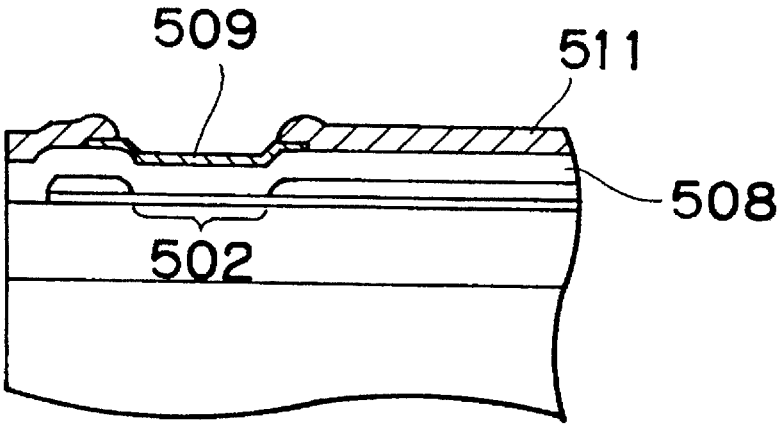
FIG. 19 is a partial cross-sectional enlarged view of another conventional recording head provided on a third upper protective layer.
Figure 20:
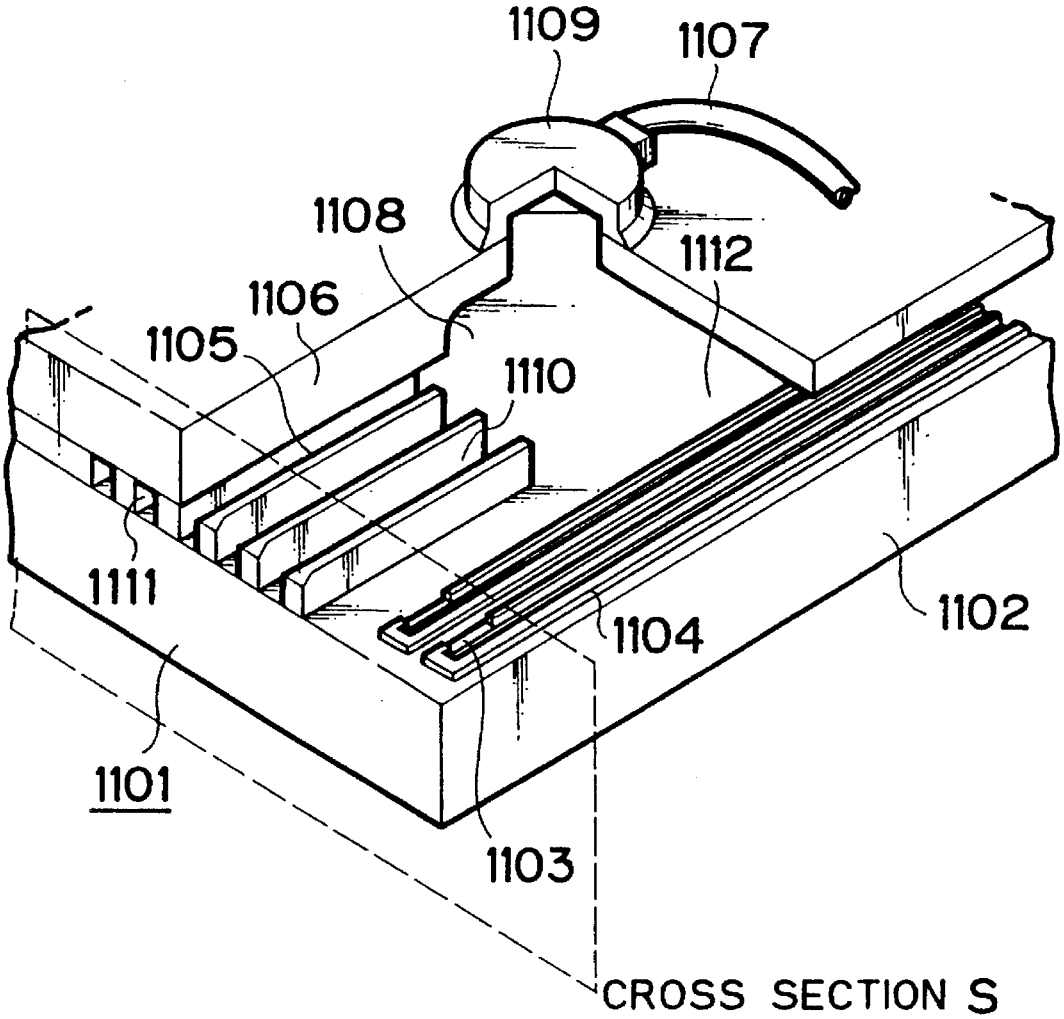
FIG. 20 is a partially cut-away perspective view for the explanation of a structure of the liquid jet recording head.
Figure 21:
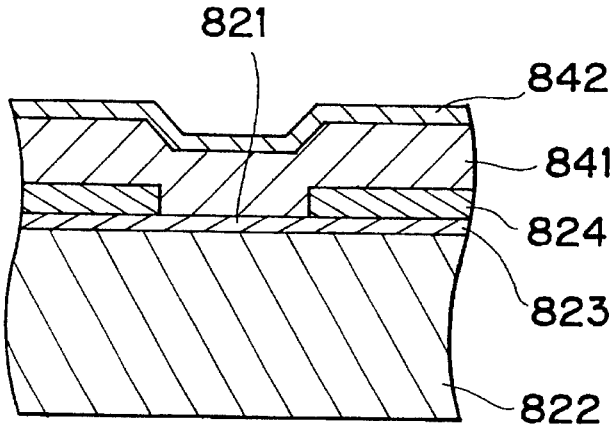
FIG. 21 is a partial cross-sectional view showing the constitution of a heater portion of an ink jet recording head.

Another embodiment is shown in FIG. 15. Even if each wiring is all covered with the second protective layer 309, the same effects could be obtained. The second protective layer is formed 0.6 μm thick, using Ta as the material. FIG. 21 is a typical partial cross-sectional view showing the constitution of a portion where heaters 821 of the ink jet recording head are provided.

This ink jet recording head is fabricated using the semiconductor fabrication process technique such as the etching, the vapor deposition or the sputtering, a number of thin film heaters 821 are collectively formed on the substrate 822 made of silicon, and further an oxidation-resistant layer (first protective layer) 841 and an anticavitation layer (second protective layer) 842 are formed so as to cover the heaters 821. The oxidation-resistant layer 841, made of $SiO_2$, for example, is a layer provided for the purpose of preventing the degradation of the heaters 821 due to oxidation. The anticavitation layer 842 is a layer for protecting the heaters 821 and the oxidation-resistant layer 841 from the cavitation arising when bubbles disappear. In this example, its internal stress is a compressive stress.

The heater 821 is constructed in such a manner as to form the film of a heating resistive layer 823 on the substrate 822, and further provide an aluminum wiring (electrode) 824 for energizing the heater 821. More particularly, if the voltage is applied across the aluminum wiring 824, a part of which is cut off, the electrical current will flow into the heating resistive layer 823 on the cut off part, which then generates the heat. The ink jet recording head was fabricated using such a substrate.

The ink jet recording head has the anticavitation layer 842 formed so that its internal stress may be a compressive stress. Accordingly, the durability of the anticavitation layer 842 is improved, as will be described later, so that the reliability of the ink jet recording head is also improved.

Next, the anticavitation layer 842 will be described in detail.

The anticavitation layer 842 in this example is to prevent the oxidation-resistant layer 841 and the heaters 821 from being broken due to the cavitation arising when bubbles disappear, in which the stress within the anticavitation layer 842 is a compresive stress. The material of the anticavitation layer 842 may be appropriately used as long as it has a resistive force against cavitation, but corrosion resistance must be considered because the anticavitation layer 842 is directly in contact with the recording liquid. Normally, it is a thin film of tantalum (Ta) formed by sputtering.

Experiments were performed to clarify the relation between the internal stress and the durability for the anticavitation layer 842.

(Experiment 1)

Figure 22:
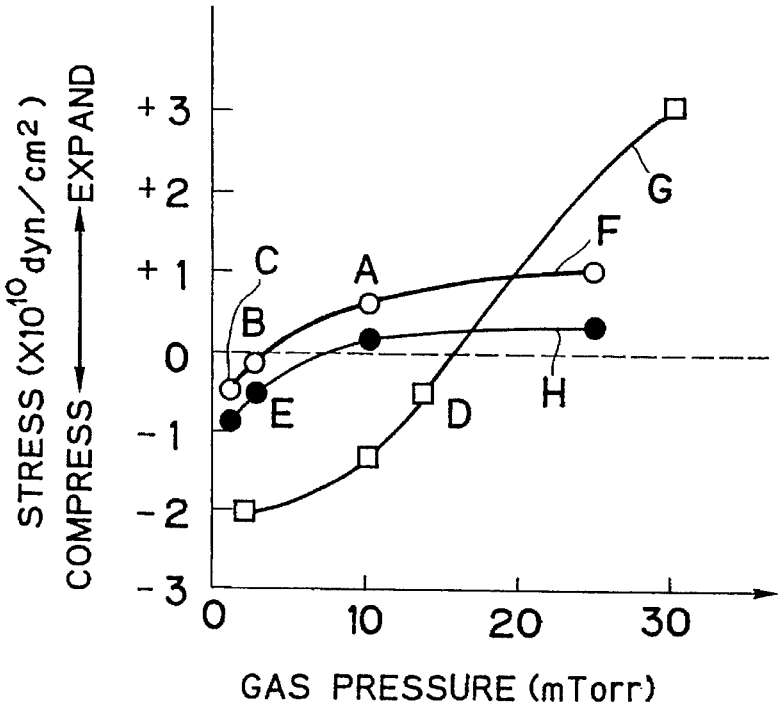
FIG. 22 is a characteristic diagram showing the correlation between the pressure and the internal stress during sputtering.

First, the relation between the film formation condition and the internal stress was investigated. That is, the relation between the pressure within a sputtering apparatus and the internal stress of a tantalum thin film was investigated, when the thin film of tantalum was formed on the substrate by sputtering. The sputtering apparatus was 603-type sputtering apparatus made by MRC and 1015-type sputtering apparatus by Nichiden Aneruba. Also, the measurement of the internal stress was made in such a manner as to measure the warp of the substrate with the laser beam, which was produced in forming the thin film of tantalum on the substrate. Also, the sample fabricated with the sputtering apparatus made by MRC was annealed at 300° C. for 1.5 hours in the nitrogen atmosphere under the atmospheric pressure, after the formation of film, and the internal stress after annealing was measured. These measurement results are shown in FIG. 22. In FIG. 22, the curves F, G and H show the results of annealing when the apparatus made by MRC, Nichiden Aneruba, and MRC are used, respectively. As will be clearly seen from the results, the relation between the sputtering pressure and the internal stress of the film is different depending on the structure of film formation apparatus. The internal stress is shifted toward the compression side by heating and annealing the sample on which the film is formed.

Particularly, it will be found that the internal stress reacts sensitively to the variation pressure in the neighborhood of where the internal stress is zero. That is, even if it is attempted to make the internal stress to be zero, the internal stress of the film tends to occur on the compression or tension side. Further, since the internal stress of formed film may be different, even with the same sputtering pressure, depending on the position of a pressure sensor for monitoring the sputtering pressure, it will be found that fine control of the film formation condition is necessary to adjust the internal stress of the anticavitation layer.

(Experiment 2)

Next, an experiment was conducted to examine how the durability of the anticavitation layer is changed when the internal stress of the anticavitation layer is different. Since it is clear that the liquid channel wall and the ceiling plate are not concerned in the durability of the anticavitation layer 842, with the ink jet recording head as above mentioned, the durability of the anticavitation layer was evaluated by fabricating a heater board having a number of heaters, the oxidation-resistant layer, and the anticavitation layer on the substrate as the sample.

First, on a silicon substrate was formed a resistance layer made of hafnium boride ($HfB_2$) having a thickness of 1000 Å by sputtering, on which an aluminum layer having a thickness of 6000 Å was further formed by the sputtering. After that, the aluminum wiring was made by cutting off a part of the aluminum layer with a photolithography process, and the heaters were formed on the substrate. Several hundred of heaters were provided on each substrate. Next, on a face of the substrate where the heaters were provided, a 1.9 μm thick film of $SiO_2$ was formed as the oxidation-resistant layer by sputtering, and further an anticavitation layer made of tantalum was formed on the oxidation-resistant layer by sputtering. At this time, five kinds of samples as previously mentioned were obtained by changing the film formation conditions in five ways. Then, the oxidation-resistant layer and the anticavitation layer were made in the predetermined shape with photolithography in order to fabricate the samples of the heater board.

Here, the film formation conditions of the anticavitation layer will be described.

Assuming that five kinds of samples are samples A to E, with the pressure of each sample at the film formation corresponding to A to E as shown in FIG. 22. That is, for the samples A to C, an RF power of 1.5 kW was input, substrate was set at the room temperature, and an anticavitation layer of tantalum having a film thickness of 5000 Å was formed, using the 603-type sputtering apparatus made by MRC. Then, the sputtering pressure was set to 10 mTorr for the sample A, 3 mTorr for the sample B, and 1 mTorr for the sample C. For the sample D, a DC power of 2.0 kW was input, the substrate was set at a temperature of 150° C., the sputtering pressure was set at 13.5 mTorr, and an anticavitation layer of tantalum having a film thickness of 5000 Å was formed, using the 1015-type sputtering apparatus made by Nichiden Aneruba. For the sample E, the film formation was performed under the same conditions as for the sample B, and the annealing was made by the heating in the nitrogen atmosphere under an atmospheric pressure at set 300° C. for 1.5 hours. By referring to FIG. 22, it will be seen that the internal stress of the anticavitation layer for each sample is a tensile stress of $7\times10^9$ dyn/cm$^2$ for the sample A, a compressive stress of 2×10 dyn/cm for the sample B, and a compressive stress of 5×10 dyn/cm for the samples C to E.

Figure 23:
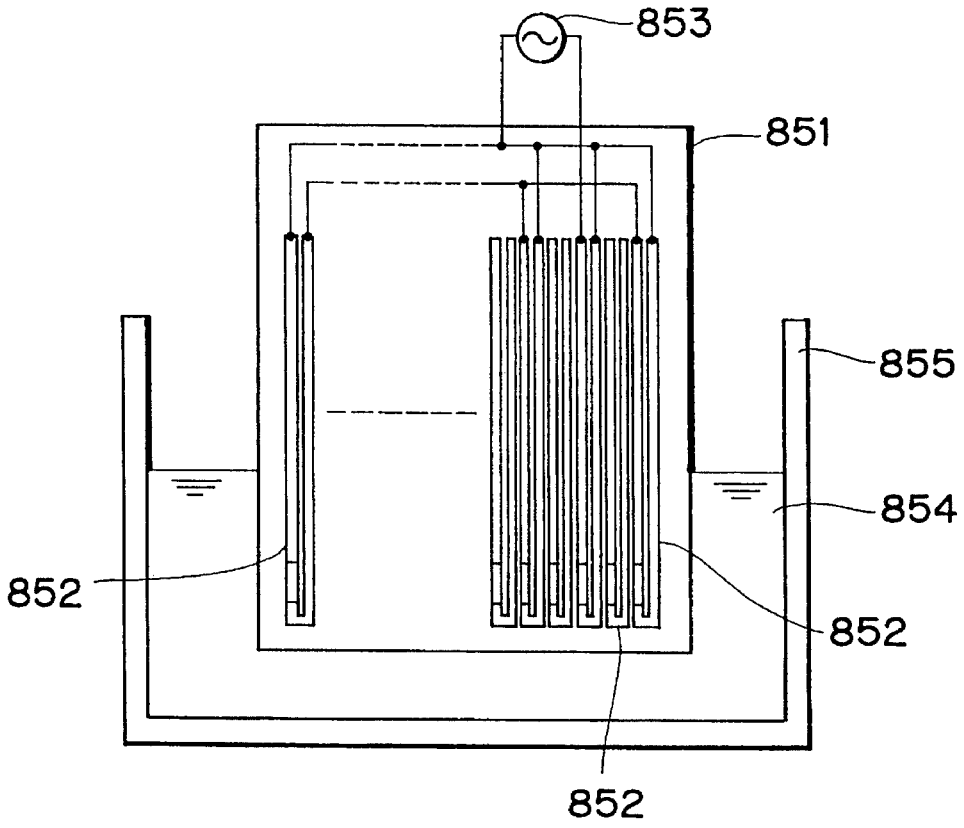
FIG. 23 is a typical explanation view for explaining a method of practicing an endurance test of the anticavitation layer.

Next, an endurance test was conducted by practically immersing a sample of heater board into the ink and energizing a respective heater. FIG. 23 is an explanation view for illustrating the method of practicing the endurance test. A number of heaters 852 contained in a sample of one heater board 851 are connected in parallel to a power supply 853 for every other heater, this sample 851 is contained in a container 855 in which the ink is reserved, and the heating portion of each heater 852 is immersed in the ink 854. The pulses with a pulse width of 7 μm and at a repetitive frequency of 4.5 kHz were applied from the power source 853, until the total number of pulses reached $1\times10^8$. The pulse voltage was set at 1.25 times the drive voltage normally applied to the heaters 852. Among a number of heaters 852, the number of heaters 852 whose anticavitation layer had not been broken was obtained, and the survival rate was calculated. The results were shown in FIG. 24.

Figure 24:
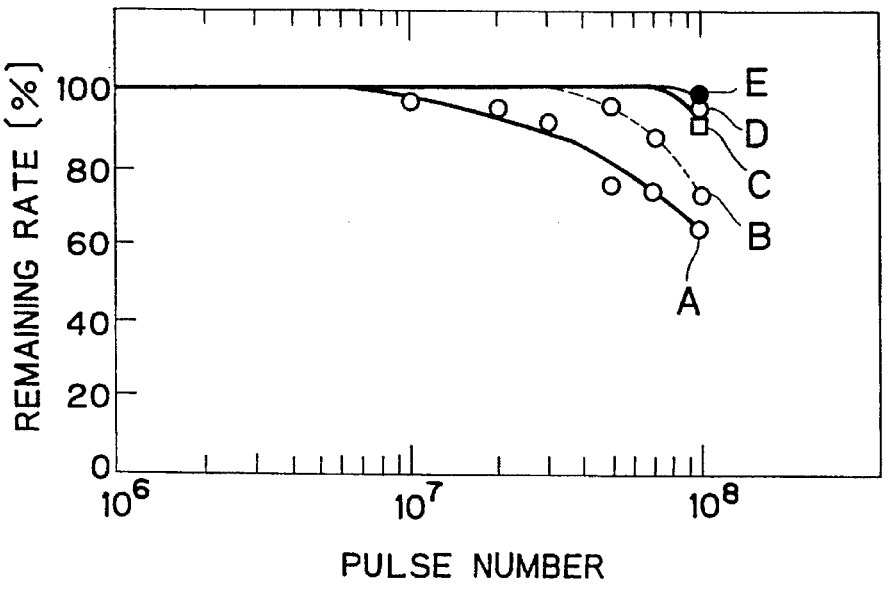
FIG. 24 is a characteristic diagram showing the durability of the anticavitation layer.

As will be clear from FIG. 24, the anticavitation layer achieves better results in the samples B to E of compressive stress than in the sample A of tensile stress, and particularly, the durability of the samples C to E having a compressive stress of $5\times10^9$ dyn/cm$^2$ are improved. Here, the comparison of the sample B with the sample E indicates that the sample E is superior in durability, though with respect to the condition of forming the anticavitation layer, the condition for the anticavitation layer by sputtering is the same, and the internal stress is only different depending on whether or not it is stronger on the compressive side due to subsequent annealing. Further, as the durability of the sample E is substantially the same as that of the sample C, D having the same internal stress, it will be found that the durability of the anticavitation layer is greatly associated with whether or not the internal stress is a compressive stress. The magnitude of the compressive stress is preferably from $1\times10^8$ to $3\times10^{10}$ dyn/cm$^2$, and more preferably from $5\times10^9$ to $3\times10$ dyn/cm$^2$ in effectiveness.

While the constitution of the anticavitation layer was described, the present invention is not limited to the instance where the internal stress of the anticavitation layer is made a compressive stress by controlling the pressure during sputtering, but the internal stress of the anticavitation layer can be made a compressive stress by applying a negative bias voltage during sputtering, or using other light element gases instead of argon gas.

An example of a recording head cartridge to which the present invention is applicable and an ink jet recording apparatus using the head is shown in the following embodiment.

Figure 10:
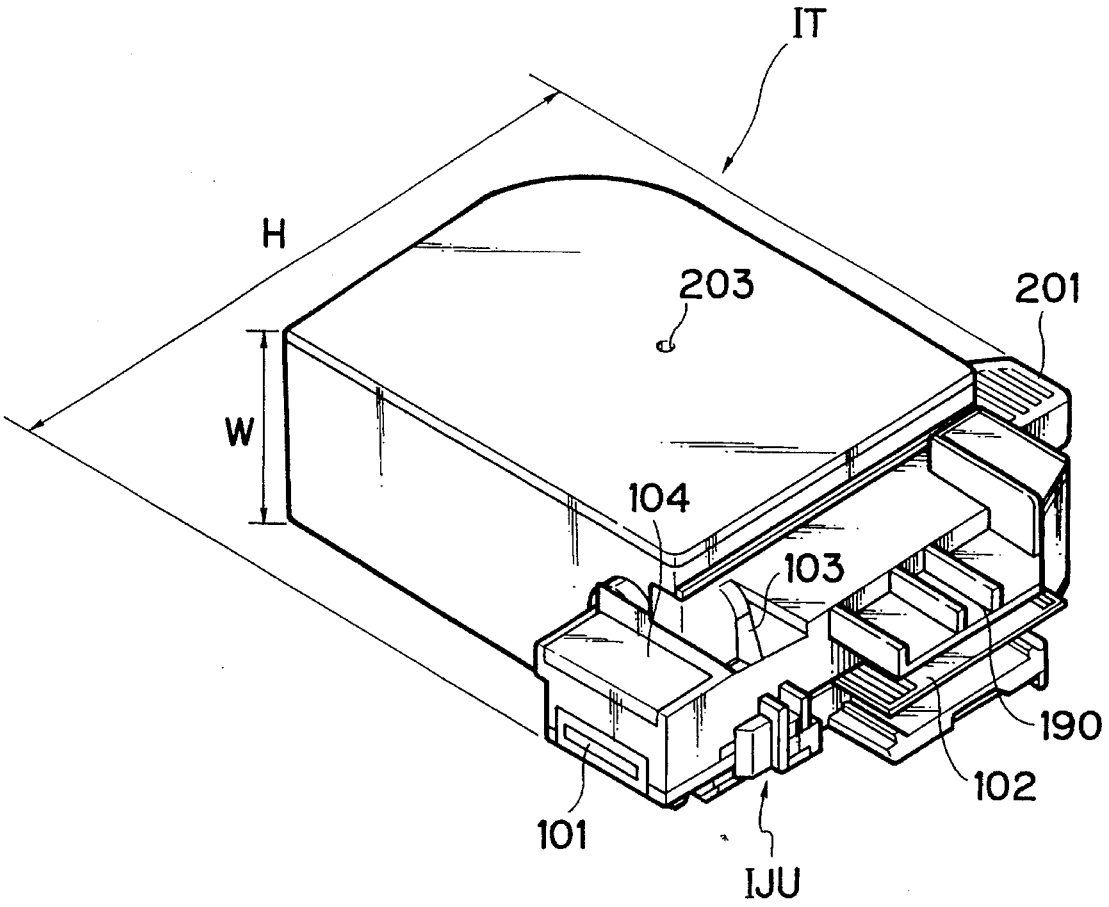
FIG. 10 is a perspective view of a recording head cartridge which can be constituted using the substrate in each embodiment.
Figure 12:
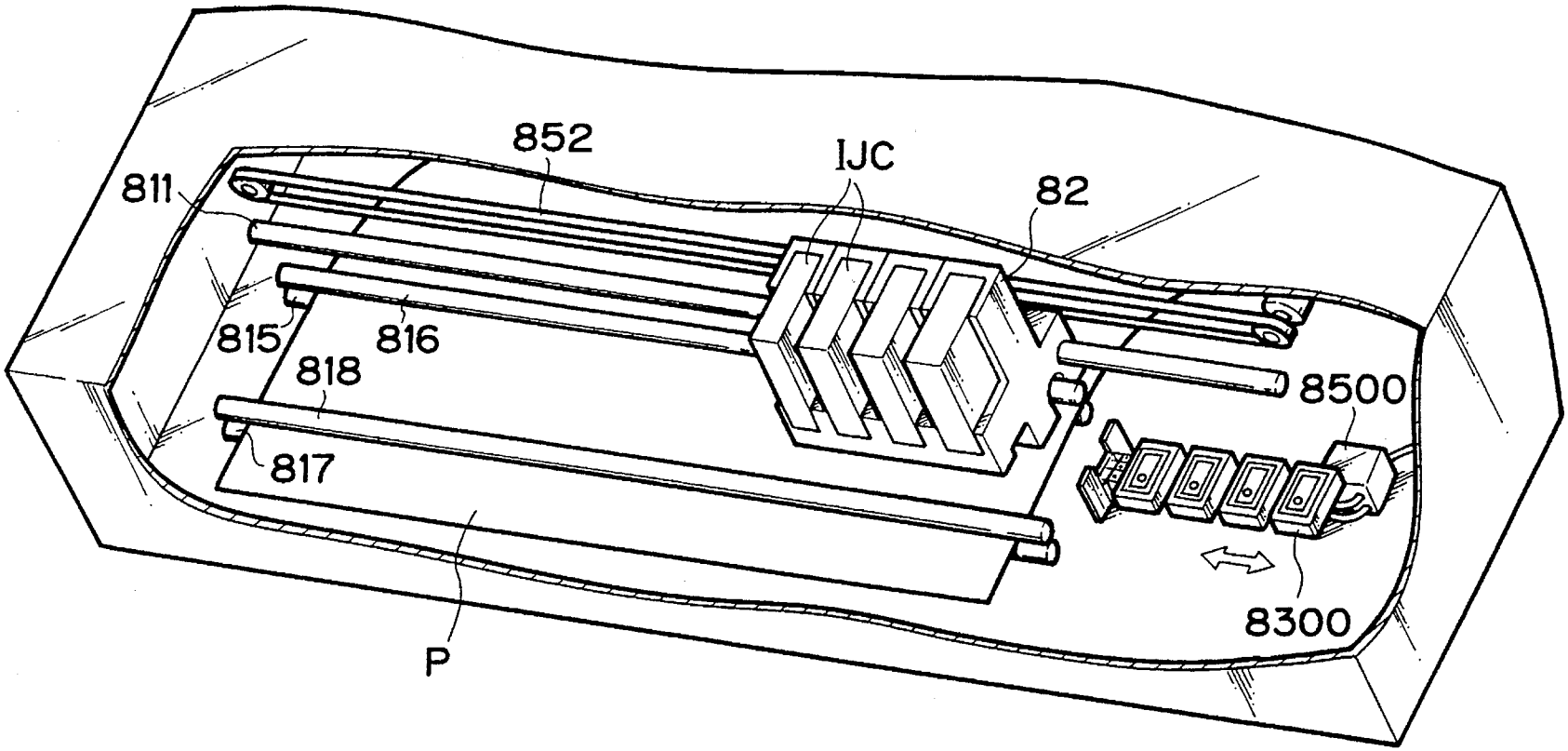
FIG. 12 is a perspective view of the ink jet recording apparatus onto which the recording head cartridge as shown in FIG. 10 can be mounted.

FIG. 10 shows one constitutional example of a head cartridge mountable on a carriage of the ink jet recording apparatus as shown in FIG. 12. The cartridge in this embodiment has an ink tank unit IT and a head unit IJU integrated together, which are detachable from each other. A wiring connector 102 for outputting an ink residual amount detection signal as well as receiving a signal for driving an ink discharge portion 101 of the head unit IJU which can be constituted by the substrate as shown in the above embodiment is provided at a position juxtaposed with the head unit IJU and the ink tank unit IT. Accordingly, the height H of the cartridge can be lowered in attitude with the cartridge mounted onto the carriage as hereinafter described, and further, the thickness of the cartridge can be made thinner. As a result, it is possible to arrange the cartridges side by side, and make the carriage smaller, as will be described in FIG. 12.

The head cartridge can be mounted onto the carriage by grasping a knob 201 provided on the ink tank unit IT, with the discharge portion 101 directed downward. This knob 201 engages a lever provided on the carriage, which is used to mount the cartridge. In the mounting operation, a pin provided on the carriage side engages a pin engaging portion 103 of the head unit IJU to position the head unit IJU.

The head cartridge in this example has an absorbing member 104 juxtaposed with the ink discharge portion 101, which serves to clean a member for wiping and cleaning a surface of the ink discharge portion 101. An atmosphere communicating port 203 for introducing the air along with the consumption of the ink is provided in an almost central portion of the ink tank unit IT.

Figure 11:
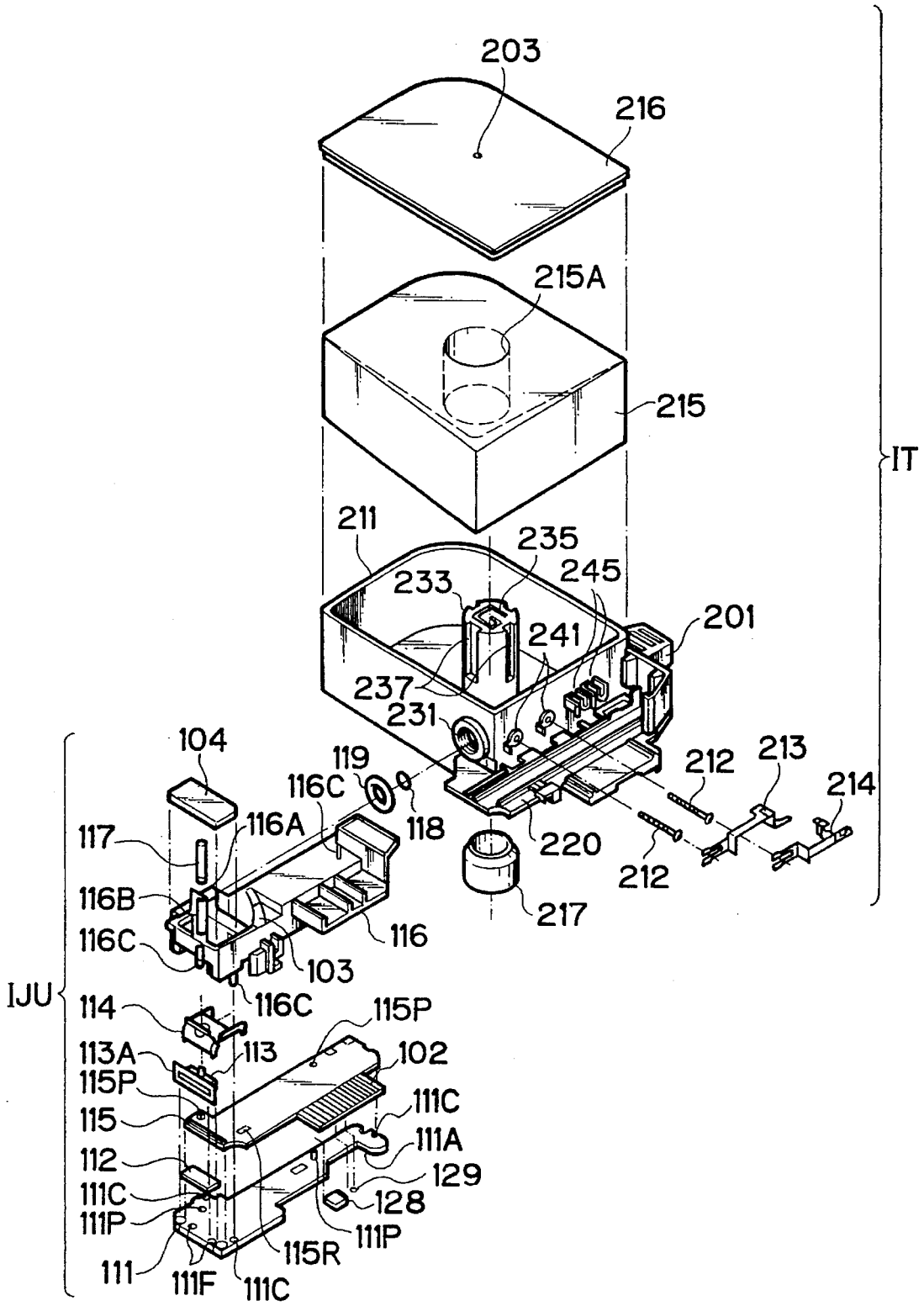
FIG. 11 is an exploded perspective view of the recording head cartridge as shown in FIG. 10.

FIG. 11 is an exploded perspective view of the head cartridge as shown in FIG. 10. The head cartridge in this embodiment is composed of the head unit IJU and the ink tank unit IT, the detailed constitution of which will be described with reference to this figure.

Head Unit

The reference in packaging the components is a base plate 111 formed of A1, which packages thereon the substrate 20 having formed a group of elements for generating the energy for use in discharging the ink, and a print circuit substrate (PCB) 115 having the wirings for supplying the electric power to the elements, which are connected with the wire bonding. On the substrate 20 are provided, as the element, electricity-heat converters 21 for generating the heat energy causing the film boiling in ink upon the energization. This substrate 20 is often referred to as a heater board.

The above-mentioned wiring connector 102 constitutes a part of PCB 115, in which a drive signal from the control circuit, not shown, is received by the wiring connector 102 and supplied via PCB 115 to the heater board 20. The PCB 115 is a double wiring substrate, in which there are further disposed an IC 128 of ROM storing the appropriate drive condition for electricity-heat converters, the ID number, the ink color information, the drive condition correction data (head shading (HS) data), and the PWM control condition, and a condenser 129.

The IC 128 and the condenser 129 are disposed on the side of a composition plane with the base plate 111 of the PCB 115, and at a position corresponding to a cut off portion 111A of the base plate 111. Consequently, if the height with the IC mounted is equal to or less than the thickness of the base plate 111, the IC does not protrude beyond the surface in joining the PCB115 and the base plate 111. Accordingly, it is unnecessary to take into consideration the storage form corresponding to its protrusion in the fabrication process.

On the heater board 20 are disposed a common liquid chamber for temporarily reserving the ink supplied from the ink tank unit IT, and a ceiling plate 113 having a recess portion for forming a group of liquid channels each connecting a liquid chamber to a discharge port. Also, on this ceiling plate 113 is formed integrally a discharge port forming member (orifice plate) 113A on which the ink discharge port is formed. Numeral 114 denotes a presser spring for constituting the discharge portion 101 by joining closely the ceiling plate 113 and the heater board 20.

116 is a head unit cover which is a member comprising an ink supply tube unit 116A penetrating into the ink tank unit IT, an ink flow passage 116B for the communication of ink to an ink inlet tube on the ceiling side, three pins 116C for positioning or securing at three points with the base plate 111, a pin engaging portion 103, a mounting portion of the absorbing member 104, and other necessary portions which are integrally moulded. A flow passage lid 117 is placed on the ink flow passage 116B. At a leading end of the ink supply tube 116A are disposed a filter 118 for the removal of bubbles and dust, and an O ring for preventing the ink leading from the connecting portion.

In assembling the head unit as above mentioned, the base plate is positioned and fixed by an adhesive or the like so that the pin 111P projecting from the base plate may be inserted into a through hole 115P on the PCB 115. In fixing both, high accuracy is not. This is because the heater board 20, which should be attached to the base plate 111 with high accuracy, is fixed separately from the PCB 115.

Next, the heater board 20 is disposed and secured on the base plate 111 with high accuracy, and then the necessary electrical connections are made with the PCB 115. The ceiling plate 113 and the spring 114 are disposed with adhesion and sealing as necessary, and then the positioning is made by inserting three pins 116C protruding from a cover into holes 111C of the base plate 111. The head unit can be completed by thermally fusing these three pins 116C.

Ink Tank Unit

In FIG. 11, 211 is an ink vessel which denotes a main body of the ink tank unit, 215 denotes an ink absorbing member for impregnating the ink, 216 denotes an ink tank lid, 212 denotes electrode pins for detecting the ink residual amount, and 213 and 214 denotes contact members with the pins 212.

The ink vessel 211 has a hollow cylindrical portion 233 located substantially in a central portion from the bottom face side in FIG. 11, as well as integrally having the pins 212, a portion 220 for attaching the contact members 213, 214 and mounting the above-mentioned head unit IJU, a supply port 231 for permitting the entry of the ink supply tube 116A, and a knob 201, Such an ink vessel can be formed by the integral moulding of resin.

The bottom face side of the cylindrical portion 233 is open in consideration of the ink filling process, and after filling, a cap 217 as shown in FIG. 11 is attached thereon to shut off the atmosphere. On the other hand, its upper end face in FIG. 11 is provided with a vortex or zigzag groove 235 (zigzag in the shown embodiment), at one end 235A of which (a center of zigzag groove in the shown embodiment) is provided an open hole passing into an internal space of the cylindrical portion 233. The other end 235B of the groove is located at a site of an atmosphere communicating port 203 provided on a tank lid 216.

On the side face of the cylindrical portion 233 are provided a plurality of grooves 237 (four is shown in the embodiment) at equal angles, which communicate to an internal space of the cylindrical portion 233. As a result, the interior of the ink tank unit and the atmosphere communicated with each other via the atmosphere communicating port 203, the zigzag groove 233, the internal space of the cylindrical portion 233 and the grooves 237. The internal space of the cylindrical portion 233 functions as a buffer portion for preventing the leakage of ink due to vibration or fluctuation. As the zigzag groove 233 serves to lengthen a path leading to the atmosphere communicating port 203, the leakage of the ink can be more effectively prevented.

Because a plurality of grooves 237 are provided at equal angles on the side face of the cylindrical portion 233 in an almost central portion of the ink tank as shown in this example, the uniform balanced state for the absorbing member 215 located around the periphery with the atmosphere can be assured, and the ink within the absorbing member can be prevented from locally concentrating. This can also assure a smooth supply of the ink to a compression area of the absorbing member (the periphery of the supply port 231).

Note that the groove 237 extends below a center of the thickness W1 of the vessel, and completely covers the area where the supply port 231 exists. Also, it is formed considering the positions of residual detection pins 212, whereby the uniform ink existing state or atmosphere communicating state can be assured around the pin existing portion to improve the accuracy of detecting the residual amount.

The ink impregnating absorbing member 215 in this embodiment is provided with a hole 215A allowing for the insertion of the cylindrical portion 233. Because of the cylindrical portion 233 located in the hole 215A, the absorbing member 215 is not compressed against the cylindrical portion 233, and the ink does not remain in the compressed portion at a highly negative pressure. On the other hand, the absorbing member 215 in this example has a slighly bulged portion located at the supply port 231 in a spatial shape formed by the ink tank lid 216 and the ink vessel 211. As a result, as the bulged portion is compressed when the absorbing member 215 is stored within the ink tank unit, the absorbing member has a highly negative pressure at that portion, so that the ink can be introduced into the supply port 231.

FIG. 12 is a schematic perspective view of the ink jet recording apparatus using the recording head cartridge. This apparatus is a printer comprising exchangeable recording head cartridges of the ink tank integral type corresponding to four colors of ink for black (Bk), cyan (C), magenta (N) and yellow (Y). The head useful in this printer has 128 discharge ports with a resolution of 400 dpi and at a drive frequency of 4 kHz.

In FIG. 12, IJC is four recording head cartridges each corresponding to each ink of Y, M, C and Bk, the recording head and the ink tank for reserving the ink being formed integrally. Each recording head cartridge IJC is detachably mounted onto the carriage with a mechanism, not shown. The carriage 82 is slidably engaged along a guide shaft 811, and connected to a part of a drive belt 852 moved by a main scan motor, not shown. As a result, the recording head cartridge IJC can be moved for a scanning operation along the guide shaft 811. 815, 816 and 817, 818 denotes conveying rollers extending substantially parallel to the guide shaft 811 at the back side and the front side of the recording area as shown. The conveying rollers 815, 816 and 817, 818 are driven by a sub scanning motor, not shown, to convey a recording medium P. The recording medium P to be conveyed is opposed to a face where the discharge port face of the recording head cartridge IJC is disposed so as to make up a recording face.

Adjacent the recording area of the recording head cartridge IJC, a recovery unit is provided on a movable area of the cartridge IJC. In the recovery unit, 8300 denotes a cap unit, each cap corresponding to a respective one of a plurality of cartridges IJC having recording heads, in which the cap unit is slid able in the left and right directions along with the movement of the carriage 82, and can be raised and lowered in the upward and downward directions, respectively. When the carriage 82 is located at a home position, the cap unit is connected with the recording head unit to the cap. Also, in the recovery unit, 8401 denotes a blade functioning as the wiping member. Further, 8500 denotes a pump unit for absorbing the inks from the discharge port of the recording head and its neighborhood via the cap unit 8300.

The present invention brings about excellent results particularly in a recording head or a recording device comprising means (e.g., electricity-heat converter or laser beam) for generating heat energy as the energy for use in discharging the ink, and causing the state of the ink to be changed with the heat energy, among the various ink jet recording systems. With such a method, a higher density and higher resolution of recording can be obtained.

As to its representative constitution and principle, for example, one practiced by use of the basic principle disclosed in, for example, U.S. Pat. Nos. 4,723,129 and 4,740,796, is preferred. This system is applicable to either of the so-called on-demand type and the continuous type printers. More particularly, the use of this system with the on-demand type printer is effective because, by applying at least one driving signal which gives rapid temperature elevation exceeding nucleus boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding, one by one, to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish discharging of the liquid (ink) which has excellent response characteristics. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the recording head of U.S. Pat. Nos. 4,558,333, or 4,459,600 disclosing the arranging of the heat acting portion in the flexed region is also included in the present invention. In addition, the present invention can be also effectively made in accordance with Japanese Patent Laid-Open No. 59-123670 which discloses using a slit common to a plurality of electricity-heat converters as the discharging portion of the electricity-heat converter or Japanese Patent Laid-Open No. 59-138461 which discloses having the opening for absorbing a pressure wave of heat energy correspond to the discharging portion. Thus, the present invention allows the recording to be made assuredly and efficiently in whatever form the recording head may be.

Further, for the recording head of the full line type having a length corresponding to the maximum width of a recording medium which can be recorded by the recording device, the present invention can be effectively applied. As such a recording head, either the constitution which satisfies its length by a combination of a plurality of recording heads or the constitution as one recording head integrally formed may be used.

In addition, among the serial-types in the above example, the present invention is also effective for a recording head secured on a main apparatus, a recording head of the freely exchangeable chip type which enables electrical connection to the main device or the supply of ink from the main device by being mounted on the main device, or a recording head of the cartridge type having an ink tank integrally provided on the recording head itself.

Also, the addition of a restoration means for the recording head, a preliminary auxiliary means, etc. is preferable, because the effect of the present invention can be further stabilized. Specific embodiments of these may include, for the recording head, a combination of capping means, cleaning means, pressurization or suction means, electricity-heat converters or another type of heating element, or preliminary heating means and it is also effective for performing in a stable recording to perform preliminary mode which performs discharging separate from recording.

Further, as the type or number of recording heads to be mounted, for example, a single recording head may be provided corresponding to monocolor, or a plurality of recording heads may be provided corresponding to a plurality of inks having different recording colors or densities. That is, as the recording mode of the recording device, the present invention is extremely effective for not only recording only a primary color, such as black etc., but also as a device equipped with at least one of plural different colors or full color by color mixing, whether the recording head is either integrally constituted or combined in a plural number.

In addition, though the ink is the liquid in the embodiments of the present invention as described above, it is also sufficient if the ink is solid at or below room temperature and softens or liquefies at room temperature, or liquefies when a recording enable signal is issued, as it is common with ink jet recording devices to control the viscosity of ink to be maintained within a certain range for stable discharge by adjusting the temperature of ink in a range from 30° C. to 70° C.

In addition, in order to avoid temperature elevation due to heat energy by positively utilizing the heat energy as the energy for the change of state from solid to liquid, or to prevent the ink from evaporating by the use of the ink stiffening in a shelf state, the ink having a property of liquefying only with the application of heat energy is also applicable in the present invention, in which the liquid ink may be discharged with the application of heat energy in accordance with a recording signal, or the ink may already solidify upon reaching a recording medium. In this case, the ink may be in the form of being held in recesses or through holes of porous sheet as liquid or solid matter, and opposed to electricity-heat converters, as described in Japanese Patent Applications Laid-Open No. 54-56847 or No. 60-71260. The most effective method for inks as above described in the present invention is one based on the film boiling as above indicated.

Further, an ink jet recording apparatus according to the present invention may be used in the form of an image output terminal in the information processing equipment such as a computer, a copying machine in combination with a reader, or a facsimile terminal equipment having a transmission and reception feature.

As above described, if the area of a layer in contact with the ink on the substrate on which the electricity-heat converters are formed and having the electrical conductivity and ink resistivity is minimized as required, it is possible to make smallest the probability of causing discharge breakdown due to electrostatic discharge between a driving circuit such as Al wiring, a temperature sensor and a heater, which are formed on the above-mentioned layer and the substrate. As a result, because special external countermeasures against static electricity are unnecessary, it is possible to realize a highly reliable recording head with no increase in cost. As it is only necessary to exchange the Ta mask, an increase of in the cost will not occur.

Also, as the second protective layer is provided only over the wirings on the first protective layer, there are fewer occurrences of pin holes in etching $Ta/SiO_2$, for example, so that the electrical leakage between the wiring and the ink is reduced, and the yield in the fabrication is improved, whereby the fabrication cost can be reduced. Further, as the second protective layer is only provided over the wirings, but not over the entire chip, stress is reduced, and the adherence force is improved. Therefore, the life of a liquid jet recording head can be lengthened due to reduced thermal damage.

In addition, as the internal stress of the anticavitation layer is a compressive stress, the durability of the anticavitation layer is improved, so that the anticavitation layer may not be damaged even if the heat energy generating element is repeatedly driven, and the heat energy generating element also not damaged, whereby the reliability of the ink jet recording head is improved sufficiently to withstand a number of recording operations.

What is claimed is:

1. An ink jet recording head comprising:

an energy generating member for generating energy for discharging ink and a circuit electrically connected to said energy generating member, said energy generating member and said circuit being disposed on a substrate;

an insulative layer formed on said energy generating member and said circuit; and a conductive protecting member formed above said energy generating member and said circuit on said insulative layer, said protecting member extending to all areas where the ink directly contacts the substrate, but not extending to portions of the substrate where the ink does not contact the substrate.

2. The ink jet recording head according to claim 1, wherein the area where said protecting member is formed is further determined in accordance with the thermal distribution of said energy generating member.

3. The recording head according to claim 1, wherein said protecting member is a Ta film.

4. An ink jet recording head according to claim 1, wherein only said insulative member and said protecting member are positioned in the area where the ink directly contacts the substrate.

5. An ink jet recording head comprising:

energy generators for generating energy used to discharge ink;

a circuit electrically connected to said energy generators;

a substrate on which temperature sensors for detecting a temperature of said recording head or temperature-adjusting heaters for adjusting the temperature of said recording head are formed; and a conductive protective member disposed above said energy generators, said circuit, and an insulating layer of said substrate, wherein said temperature sensor or said temperature-adjusting heater is arranged to be offset from an area where said conductive protective member is formed, when viewed in a thickness direction of said substrate.

6. The ink jet recording head according to claim 5, wherein the area where said protective member is formed is further determined in accordance with the thermal distribution of said energy generators.

7. The recording head according to claim 5, wherein said protective member is a Ta film.

8. An ink jet recording apparatus comprising: an ink jet recording head having an energy generating member for generating energy for discharging ink and a circuit electrically connected to said energy generating member, said energy generating member and said circuit being disposed on a substrate;

an insulative layer formed on said energy generating member and said circuit; and a conductive protecting member formed above said energy generating member and said circuit on said insulative layer, said protecting member extending to all areas where the ink directly contacts the substrate, but not extending to portions of the substrate where the ink does not contact the substrate.

9. The recording head according to claim 8, wherein said protective member is a Ta film.

10. The ink jet recording apparatus according to claim 8, wherein the area where said protective member is formed is further determined in accordance with the thermal distribution of said energy generators.

11. An ink jet recording apparatus comprising:

an ink jet recording head having:

energy generators for generating energy used to discharge ink;

a circuit electrically connected to said energy generators;

a substrate on which temperature sensors for detecting a temperature of said recording head or temperature-adjusting heaters for adjusting the temperature of said recording head are formed; and a conductive protective member disposed above said energy generators, said circuit, and an insulating layer of said substrate, wherein said temperature sensor or said temperature-adjusting heater is arranged to be offset from an area where said conductive protective member is formed, when viewed in a thickness direction of said substrate.

12. The recording head according to claim 11, wherein said protective member is a Ta film.

13. The ink jet recording apparatus according to claim 8, wherein the area where said protective member is formed is further determined in accordance with the thermal distribution of said energy generators.

* * * * *

UNITED STATES PATENT AND TRADEMARK OFFICE

CERTIFICATE OF CORRECTION

PATENT NO. : 5,491,505

DATED : February 13, 1996

INVENTOR(S) : TOSHIO SUZUKI ET AL.

It is certified that error appears in the above-identified patent and that said Letters Patent is hereby corrected as shown below:

COLUMN 1

Line 54, close up right margin.
Line 55, close up left margin.

COLUMN 2

Line 44, "quantity of respect to the" should read --respect to the quantity of--.
Line 52, "though" should read --thought--.
Line 66, "site" should read --sites--.
Line 67, "more is" should read --more likely site is-- and "of" should be deleted.

COLUMN 4

Line 32, "said" should read --a--.

COLUMN 6

Line 27, "of" (first occurrence) should read --of the--.

COLUMN 8

Line 66, "least as" should be deleted.

COLUMN 9

Line 11, "adhesive" should read --adhesive is--.

UNITED STATES PATENT AND TRADEMARK OFFICE

CERTIFICATE OF CORRECTION

PATENT NO. : 5,491,505

DATED : February 13, 1996

INVENTOR(S) : TOSHIO SUZUKI ET AL.

It is certified that error appears in the above-identified patent and that said Letters Patent is hereby corrected as shown below:

COLUMN 10

Line 10, "ti," should read --Ti,--.
Line 31, "defectives" should read --defective--.
Line 63, close up right margin.
Line 64, close up left margin

COLUMN 12

Line 45, "input," should read --input, the--.
Line 46, "the" should be deleted.
Line 64, "2x10 dyn/cm" should read --$2x10^9$ dyn/$cm^2$--.
Line 65, "5x10 dyn/cm" should read --$5x10^9$ dyn/$cm^2$--.

COLUMN 15

Line 34, "201," should read --201.--.

COLUMN 16

Line 58, "slid able" should read --slidable--.

COLUMN 18

Line 8, "in a" should be deleted.
Line 9, "perform" should read --perform in a--.
Line 18, "only" should be deleted.

UNITED STATES PATENT AND TRADEMARK OFFICE

CERTIFICATE OF CORRECTION

PATENT NO. : 5,491,505

DATED : February 13, 1996

INVENTOR(S) : TOSHIO SUZUKI ET AL. Page 3 of 3

It is certified that error appears in the above-identified patent and that said Letters Patent is hereby corrected as shown below:

COLUMN 19

Line 16,"element" should read --element is--.

COLUMN 20

Line 11, "comprising: an" should read --comprising: ¶ an--.
Line 12, "having" should read --having:--.

Signed and Sealed this

Twenty-third Day of July, 1996

Bruce Lehman

*Attest:*

BRUCE LEHMAN

*Attesting Officer*

*Commissioner of Patents and Trademarks*